US012078018B2

(12) United States Patent
Kash et al.

(10) Patent No.: US 12,078,018 B2
(45) Date of Patent: Sep. 3, 2024

(54) SOLID SIGNAL PUCK FOR WELLBORE PERFORATING GUN

(71) Applicant: G&H Diversified Manufacturing LP, Houston, TX (US)

(72) Inventors: James Edward Kash, Houston, TX (US); Ryan Ward, Tomball, TX (US); Benjamin Vascal Knight, Katy, TX (US); Joe Noel Wells, Lindale, TX (US); Brian Auer, Houston, TX (US); Timmothy Lee, Tomball, TX (US); Steven Zakharia, Houston, TX (US); Charles Levine, Houston, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 197 days.

(21) Appl. No.: 17/715,563

(22) Filed: Apr. 7, 2022

(65) Prior Publication Data

US 2022/0325586 A1 Oct. 13, 2022

Related U.S. Application Data

(60) Provisional application No. 63/219,541, filed on Jul. 8, 2021, provisional application No. 63/193,057, filed on May 25, 2021, provisional application No. 63/172,042, filed on Apr. 7, 2021.

(51) Int. Cl.
*E21B 17/02* (2006.01)
*E21B 43/119* (2006.01)

(52) U.S. Cl.
CPC ..... *E21B 17/028* (2013.01); *E21B 43/119* (2013.01)

(58) Field of Classification Search
CPC ..... E21B 17/028
See application file for complete search history.

(56) References Cited

U.S. PATENT DOCUMENTS

| | | | | |
|---|---|---|---|---|
| 2,598,651 | A | 5/1952 | Spencer | |
| 2012/0247771 | A1 | 10/2012 | Black et al. | |
| 2020/0256168 | A1* | 8/2020 | Knight | E21B 23/00 |
| 2020/0362652 | A1 | 11/2020 | Eitschberger et al. | |
| 2021/0293107 | A1* | 9/2021 | Eitschberger | E21B 17/02 |
| 2022/0316283 | A1* | 10/2022 | Eitschberger | E21B 47/12 |

OTHER PUBLICATIONS

International Search Report and Written Opinion dated Jun. 13, 2022, for Application No. PCT/US2022/023886.

* cited by examiner

*Primary Examiner* — Nicole Coy
*Assistant Examiner* — Yanick A Akaragwe
(74) *Attorney, Agent, or Firm* — Conley Rose, P.C.

(57) ABSTRACT

A system for connecting a perforating gun to at least one other component in a perforating tool string includes a perforating gun that includes a gun housing and a charge carrier received within the gun housing wherein the charge carrier includes a first electrical connector, a tool connected end-to-end with the perforating gun where the tool includes an outer sleeve and a second electrical connector, a solid signal puck arranged with the perforating gun and the tool where the puck forms a pressure resistant barrier between the gun and the tool and wherein the solid signal puck includes a first endface oriented and a second endface and an outer periphery between the endfaces, and wherein the largest outer diameter of the outer periphery is at least 40% of the length between the first endface and the second endface of the puck.

47 Claims, 13 Drawing Sheets

SOLID SIGNAL PUCK FOR WELLBORE PERFORATING GUN

CROSS-REFERENCE TO RELATED APPLICATIONS

The present application claims benefit of U.S. provisional patent application No. 63/172,042 filed Apr. 7, 2021, entitled "Reusable Tandem Sub for a Perforating Gun System," U.S. provisional patent application No. 63/193,057 filed May 25, 2021, entitled "Reusable Tandem Sub for a Perforating Gun System," and U.S. provisional patent application No. 63/219,541 filed Jul. 8, 2021, entitled "Reusable Tandem Sub for a Perforating Gun System," which are incorporated herein by reference in their entirety for all purposes.

STATEMENT REGARDING FEDERALLY SPONSORED RESEARCH OR DEVELOPMENT

Not applicable.

BACKGROUND

Like all steps in the process of establishing a productive hydrocarbon-producing wellbore, perforating the wellbore takes time and is performed using a substantial team and therefore, perforating efficiently and quickly is a pressing concern for the well operator. One aspect for time and cost savings is to space out the perforations where one perforating gun or just a few perforating guns are fired at a single position in the wellbore and then the tool string is then moved up the wellbore slightly to a second location for another one or several perforating guns are fired. This process of "shoot-and-move" and "shoot-and-move again" may be repeated a substantial number of times before the tool string is fully shot and then withdrawn for fracking the new perforations. One point that may be understood regarding the shoot-and-move process is that the "un-shot" perforating guns must be built to withstand the explosive force, shock, and pressure pulses resulting from the firing of explosive charges of the perforating guns positioned downhole from the un-shot perforating guns. Considering that the downhole environment of the wellbore is full of liquid, and liquids are particularly good at propagating pressure blasts, robustness is a critical design consideration for perforating guns. Typically, the inside of a given perforating gun is configured to remain dry to avoid damaging the explosive charges, provide an interior void space versus being filled with an incompressible liquid, and to avoid potentially damaging electrical components positioned within the perforating gun. A long known weak link for perforating guns is the means for electrically connecting the perforating guns together or to other tools in the tool string. This connection needs to reliably convey electrical signals and power through the connection, and withstand the explosion of an adjacent gun.

Conventionally, double-ended tandem subs have been employed for a number of years with screw threads at each end to connect adjacent perforating guns of the tool string. These tandem subs are substantially sized steel components that are typically quite heavy and robust with a small throughbore extending from end to end for the electric signal to pass between the pair of perforating guns. Typically, a pressure bulkhead or, more commonly, a pair of pressure bulkheads enclose a wire or pin and seals to the end or inside of the throughbore of the tandem sub. A small diameter pressure bulkhead is typically preferred in that a small cross-sectional area reduces the effective magnitude of a pulse or blast.

During operations for completing a hydrocarbon-producing wellbore, it is conventional practice to perforate or puncture a casing or liner string situated in the wellbore using explosive shaped charges housed within perforating guns. The perforations in the casing or liner string provide paths for formation fluids (e.g., hydrocarbons) to flow from a subterranean hydrocarbon-bearing zone into the wellbore from where the formation fluids may be conducted to the surface. It is generally desired that these paths are enlarged and extended by hydraulic fracturing or fracking after the perforation step to make each perforation more hydrocarbon productive.

Better and more reliable systems for electrically connecting and for mechanically protecting perforating guns are desired for the hydrocarbon production industry.

SUMMARY OF THE DISCLOSURE

An embodiment of a system for connecting a perforating gun to at least one other component in a perforating tool string comprises a perforating gun that includes a gun housing and a charge carrier received within the gun housing wherein the charge carrier includes a first electrical connector for conducting at least one of electrical signals and electrical power, a tool connected end-to-end with the perforating gun where the tool includes an outer sleeve and a second electrical connector within the outer sleeve for conducting at least one of electrical signals and electrical power, a solid signal puck arranged with the perforating gun and the tool where the puck forms a pressure resistant barrier between the gun and the tool and wherein the solid signal puck includes a first endface oriented generally transverse to a longitudinal axis of the gun housing, a second endface longitudinally opposite the first endface and an outer periphery between the endfaces, and wherein the largest outer diameter of the outer periphery is at least 40% of the length between the first endface and the second endface of the puck, and wherein the solid signal puck is in direct physical contact with both the first electrical connector and with the second electrical connector for conducting at least one of electrical signals and electrical power between the first electrical connector and the second electrical connector. In some embodiments, the tool that is connected end to end with the perforating gun is a second perforating gun. In some embodiments, the perforating guns each include a separate interior void space within the gun housings, and the solid signal puck not only forms a pressure resistant barrier for the perforating guns, but also seals fluids from entering either of the interior void spaces at the end to end connection. In certain embodiments, the perforating gun includes an interior void space within the gun housing, and the solid signal puck not only forms a pressure resistant barrier for the perforating gun, but also seals fluids from entering the interior void space of the gun housing. In certain embodiments, an electrically conductive signal pathway is formed between the first endface and the second endface of the solid signal puck, wherein the signal pathway is electrically insulated from the gun housing. In certain embodiments, the solid signal puck further includes an electrically insulating surface on the outer periphery. In some embodiments, the solid signal puck is at least one of frictionally, slidably and threadably received in at least one of the gun housing and the outer sleeve. In some embodiments, the system further comprises a coupler that connects end to end to both the gun housing and the outer sleeve in a manner that secures the perforating gun to the tool. In certain embodiments, the coupler is positioned to coextend with at least a portion of each of the gun housing and the outer sleeve. In certain embodiments, at least a portion of the coupler is positioned external to the gun housing and also external to the outer sleeve and at least a portion of the solid signal puck is within a portion of the gun housing and also within a portion of the outer sleeve. In some embodiments, the solid signal puck and coupler are spaced apart and not in direct physical contact with one another. In some embodiments, the tool string includes an electric circuit with a positive side of the circuit and a ground side. In certain embodiments, the coupler is part of the ground side of the electrical circuit and the solid signal puck is part of the positive side of the electrical circuit. In certain embodiments, a portion of the coupler is positioned internal to the gun housing and another portion of the coupler is positioned internal to the outer sleeve. In some embodiments, the coupler includes a throughbore and the solid signal puck is positioned within the throughbore and is sealed to the coupler, and wherein the coupler is sealed to the gun housing. In some embodiments, at least one of the endfaces of the solid signal puck is generally planar. In certain embodiments, the solid signal puck is devoid of any throughhole between the first endface and the second endface. In certain embodiments, at least one of the endfaces of the solid signal puck includes a recess for engaging one of the electrical connectors. In some embodiments, at least one of the endfaces of the solid signal puck includes a projection extending away from a center of the solid signal puck for engaging with at least one of the electrical connectors. In some embodiments, the largest outer diameter of the outer periphery is at least 50% of the length between the first endface and the second endface of the solid signal puck. In certain embodiments, the largest outer diameter of the outer periphery is at least 75% of the length between the first endface and the second endface of the solid signal puck. In certain embodiments, the largest outer diameter of the outer periphery is at least 100% of the length between the first endface and the second endface of the solid signal puck. In some embodiments, the largest outer diameter of the outer periphery of the solid signal puck is at least ¾ inch in diameter. In some embodiments, the largest outer diameter of the outer periphery of the solid signal puck is at least ¾ inch in diameter and also at least 75% of the length between the first end face and the second end face of the solid signal puck.

An embodiment of a system for connecting a perforating gun to at least one other component in a perforating tool string comprises a perforating gun that includes a gun housing having an inner surface defining a central passage of the gun housing, and a charge carrier received within the central passage of the gun housing wherein the charge carrier includes a first electrical connector for conducting at least one of electrical signals and electrical power, a tool connected end-to-end with the perforating gun where the tool includes an outer sleeve and a second electrical connector received in the outer sleeve for conducting at least one of electrical signals and electrical power, a solid signal puck positioned within the gun housing where the solid signal puck forms a pressure resistant barrier between the gun and the tool and wherein the solid signal puck includes an outer surface in sealing engagement with the inner surface of the gun housing, and wherein the solid signal puck is electrically connected to both the first electrical connector and the second electrical connector for conducting at least one of electrical signals and electrical power between the first electrical connector and the second electrical connector. In some embodiments, the tool connected end to end with the perforating gun is a second perforating gun. In some embodiments, the perforating guns each include a separate interior void space within the gun housings, and the solid signal puck not only forms a pressure resistant barrier for the perforating guns, but also seals fluids from entering either of the interior void spaces at the end to end connection. In certain embodiments, the solid signal puck includes a first endface oriented generally transverse to a longitudinal axis of the gun housing and a second endface longitudinally opposite the first endface and an electrically conductive signal pathway is formed between the first endface and the second endface of the solid signal puck, wherein the signal pathway is electrically insulated from the gun housing. In certain embodiments, the solid signal puck includes an electrically insulating outer surface. In some embodiments, the solid signal puck is at least one of frictionally, slidably and threadably received in the gun housing. In some embodiments, the solid signal puck includes a first endface oriented generally transverse to a longitudinal axis of the gun housing and a second endface longitudinally opposite the first endface wherein at least one of the endfaces of the solid signal puck is generally planar. In certain embodiments, the solid signal puck includes a first endface oriented generally transverse to a longitudinal axis of the gun housing and a second endface longitudinally opposite the first endface wherein the solid signal puck is devoid of any throughhole between the first endface and the second endface. In certain embodiments, the solid signal puck includes a first endface oriented generally transverse to a longitudinal axis of the gun housing and a second endface longitudinally opposite the first endface and the outer surface between the end faces wherein the largest outer diameter of the outer surface of the solid signal puck is at least 40% of the length between the first endface and the second endface. In some embodiments, the solid signal puck includes a first endface oriented generally transverse to a longitudinal axis of the gun housing and a second endface longitudinally opposite the first endface wherein at least one of the endfaces of the solid signal puck includes a recess for engaging with one of the electrical connectors. In some embodiments, the solid signal puck includes a first endface oriented generally transverse to a longitudinal axis of the gun housing and a second endface longitudinally opposite the first endface wherein at least one of the endfaces of the solid signal puck includes a projection for engaging with at least one of the electrical connectors. In some embodiments, the outer surface of the solid signal puck has a largest outer diameter that is at least one inch in diameter. In certain embodiments, the solid signal puck includes a first end face oriented generally transverse to a longitudinal axis of the gun housing and a second end face longitudinally opposite the first end face and an outer periphery between the end faces, and further wherein the largest outer diameter of the outer surface of the solid signal puck is at least one inch in diameter and is also at least 75% of the length between the first end face and the second end face of the solid signal puck.

An embodiment of a perforating gun for use in a perforating tool string for perforating a casing string in a wellbore comprises a generally tubular gun housing having opposite open ends and an outer wall extending between the open ends, a charge carrier received within the tubular gun housing wherein the charge carrier includes a pair of electrical connectors with one positioned at each open end of the tubular gun housing for conducting at least one of electrical signals and electrical power, a solid signal puck arranged to close and seal a first of the open ends of the tubular gun housing thereby closing an interior void space within the tubular gun housing with the charge carrier positioned therein, a closure arranged to close and seal a second of the open ends of the tubular gun housing thereby closing the other end of the interior void space within the tubular gun housing at a first end of the generally tubular gun housing, wherein the solid signal puck forms a pressure resistant barrier protecting the interior void space at the second end of the tubular gun housing, and wherein the solid signal puck is electrically connected with one of the electrical connectors of the charge carrier for conducting at least one of electrical signals and electrical power with the one electrical connector and also electrically insulated from the tubular gun housing. In some embodiments, the solid signal puck includes an outer periphery in sealing engagement with an inner surface of the tubular gun housing. In some embodiments, the solid signal puck is devoid of any throughhole. In certain embodiments, the solid signal puck includes a first endface oriented generally transverse to a longitudinal axis of the tubular gun housing and a second endface longitudinally opposite the first endface and an outer periphery wherein a largest outer diameter of the outer periphery is at least 40% of the length between the first endface and the second endface of the solid signal puck. In certain embodiments, the largest outer diameter is at least ¾ inch in diameter. In some embodiments, the largest outer diameter is at least 75% of the length between the first end face and the second end face of the solid signal puck. In some embodiments, the solid signal puck includes a first endface oriented generally transverse to a longitudinal axis of the tubular gun housing and a second endface longitudinally opposite the first endface wherein at least one of the endfaces of the solid signal puck includes a recess for engaging with the respective electrical connector. In certain embodiments, the solid signal puck includes a first endface oriented generally transverse to a longitudinal axis of the tubular gun housing and a second endface longitudinally opposite the first endface wherein at least one of the endfaces of the solid signal pucks includes a projection for engaging with the respective electrical connector. In certain embodiments, the closure comprises a second solid signal puck arranged to close and seal a second of the second of the open ends of the tubular gun housing and forming a pressure resistant barrier protecting the interior void space at the second end of the generally tubular gun housing. In some embodiments, the closure includes an assembly comprising a generally tubular body with an open bore and a second solid signal puck is sealed within the bore of the tubular body. In some embodiments, the closure comprises a second generally tubular gun housing that is inserted into the second end of the first mentioned tubular gun housing and wherein the second end of the first mentioned tubular gun housing is closed and sealed by O ring seals engaged with an inside of the second end of the first mentioned tubular gun housing, and further wherein a second solid signal puck is positioned inside the second tubular gun housing and sealed to a bore of the second tubular gun housing, and further wherein the second solid signal puck is arranged to be in direct physical contact with the other of the electrical connectors of the charge carrier inside the first mentioned tubular gun housing.

BRIEF DESCRIPTION OF THE DRAWINGS

A more complete understanding of the present invention may be obtained from the following detailed description with reference to the attached drawing figures as summarized below, in which.

DETAILED DESCRIPTION

Figure 1:
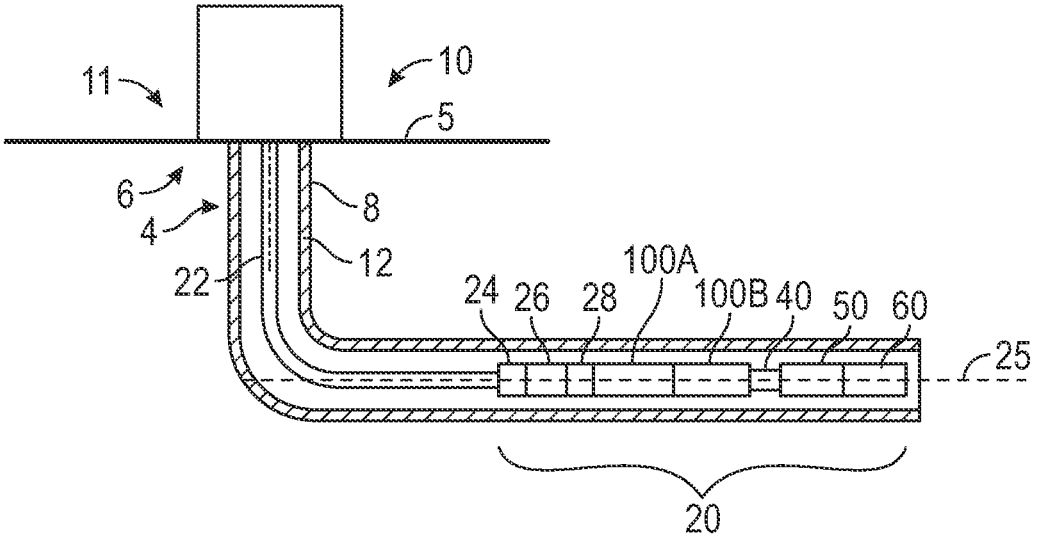
FIG. 1 is a schematic view of an exemplary system for perforating a hydrocarbon-producing wellbore including a tool string deployed by a wireline system.

The following discussion is directed to various exemplary embodiments of the present disclosure. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

Referring now to FIG. 1, a typical hydrocarbon well comprises a wellbore 4 drilled into the ground 6 at a wellsite 10 and cased with a casing string 12. Casing string 12 includes a number of segments of pipe connected end to end to keep the wellbore open and sealed to the inside wall of the hole using cement (not shown). The wellbore 4 is shown to have a generally vertical segment and a deviated segment with a long generally horizontal run extending along a target hydrocarbon bearing zone at the bottom of the vertical segment. It should be understood that arrangement is common in oil and gas wells that are thousands of feet deep and may have miles of a steered horizontal run along a target formation that is hopefully saturated with hydrocarbons. For example, arranging the well to have an extensive run along the target formation enables higher hydrocarbon productivity both in terms of the rate of production and also for total recovery of the available hydrocarbons present in the formation using a single well.

Focusing now on the system that enables recovery of hydrocarbons from the well, in this exemplary embodiment, wellsite 10 includes a surface assembly 11 at the surface or ground level 5 with a tool string 20 attached to the end of a wireline cable 22. The wireline cable is a very long, high strength, armored cable with an included capability for communicating with and powering the down hole tools in the tool string 20. Surface assembly 11 may comprise any suitable surface equipment for drilling, completing, and conducting other downhole work in the wellbore 4 and may include derricks, structures, work trucks such as a coiled tubing truck but most commonly includes a wireline truck along with surface equipment such as valves, pumps, gauges and other electrical/mechanical well control components.

Tool strings such as the tool string 20 shown in FIG. 1 are used to perforate casing strings such as casing string 12 at predetermined locations along the wellbore 4 by firing shaped charges, which are focused and directionally orientable explosives, from inside the wellbore 4 through the casing 12 and out into the surrounding formation. These perforations create channels in the formation that provide fluid access to the targeted hydrocarbons in the formation 6 to flow into the wellbore 4 through the casing 12. Typically, the channels in the formation created by the shaped charges are subjected to hydraulic fracturing that extend and branch and broaden the extent of the channels and thereby increase the effective contact area of the wellbore 4 into the targeted formation.

In this exemplary embodiment, the tool string 20, as is common, has a central or longitudinal axis 25 and includes a number of separate tools including, for example, a cable head 24 at the top which connects to the wireline 22, a casing collar locator 26 that generally indicates the depth of the tool string 20 in the wellbore 4, a direct connect sub 28, and a series of perforating guns of which two perforating guns 100A and 100B are shown that carry and orient the shaped charges. The direct connect sub 28 may include a safety switch that provides a second electrical barrier between the surface assembly 11 and switches in each perforating gun 100A and 100B. This further prevents arming of the explosives until the operators at the surface are ready to perforate the casing 12. In some embodiments, a safety switch may be included in a separate safety sub (not shown). At the bottom of the tool string 20 is a frac plug 60 which is used to create sealed partitions in the wellbore 4 so that the hydraulic fracturing may be focused on a limited number of perforations or channels at one time and thereby be more effective in enlarging many of the channels. The frac plug 60 includes various support tools including a setting tool 50, and a plug shoot firing head 40 which communicates with the surface and triggers the setting tool 50 to set the plug 60 in the wellbore 4 when signaled by the operators at the surface. It should be understood that the tool string 20 is a representative example where most tool strings typically include more than two perforating guns. It may be understood that the cable head 24, casing collar locator 26, direct connect sub 28, perforating guns 100A, 100B, frac plug 60, and other equipment of tool string 20 may also be referred to herein as tools (e.g., tools 24, 26, 28, 100A, and 100B) of tool string 20. Tool string 20 may of course comprise additional tools in other embodiments. For example, in some embodiments, tool string 20 may include additional tools such as a fish neck, weight bars, and release tools, etc.

The focus of the present disclosure relates to systems for connecting perforating guns and/or other tools in a tool string together. For example, systems for connecting the uphole perforating gun 100A to the downhole perforating gun 100B are described herein. The system generally includes a closure or solid signal puck 200 for electrically connecting the uphole perforating gun 100A with the downhole perforating gun 100B or other tools of tool string 20 where the first discussed embodiment is shown in FIGS. 2-4 where the perforating guns 100A and 100B are more clearly shown and explained.

Figure 3:
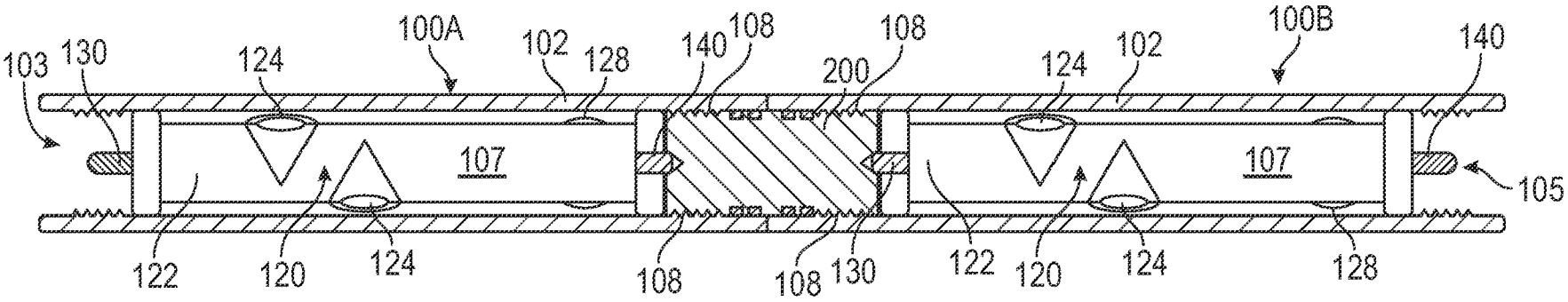
FIG. 3 is a cross-sectional side view of the solid signal puck and pair of perforating guns of FIG. 2 connected by the solid signal puck.

Focusing on FIG. 3, each of the perforating guns 100A and 100B generally include an outer sleeve or gun housing 102 and a charge carrier 120 carried within the gun housing 102. In this first exemplary embodiment, the gun housing 102 is basically formed as a tube or pipe segment having a generally circular cross-section wall with an inside surface, an outer surface, an open first or uphole end 103, an open second or downhole end 105 opposite the uphole end 103, a central bore or passage that will be closed to form an interior void space 107 within the inside surface of the gun housing 102. The charge carrier 120 is received and positioned within the central bore or passage 107 with shaped charges oriented to blast from the interior void space 107 through the gun housing 102 toward the casing 12. In this first exemplary embodiment, inside threads 108 are formed on the inside surface of the wall at each of the ends 103 and 105 of the gun housing 102. Threads 108 are sometimes termed female "box" threads however, it may be understood that different types of connectors may be utilized for mechanically connecting and securing the perforating guns 100A and 100B together in a generally end-to-end configuration.

Figure 2:
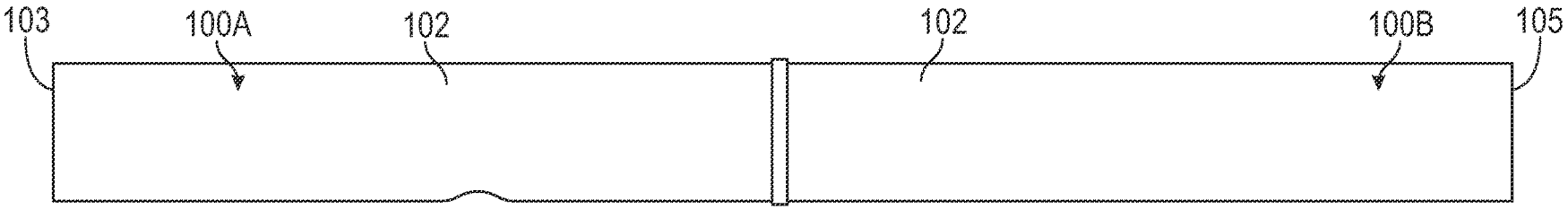
FIG. 2 is a side view of the tool string of FIG. 1 including an embodiment of a solid signal puck positioned between a pair of perforating guns of the tool string for physically protecting and electrically connecting the pair of perforating guns.
Figure 4:
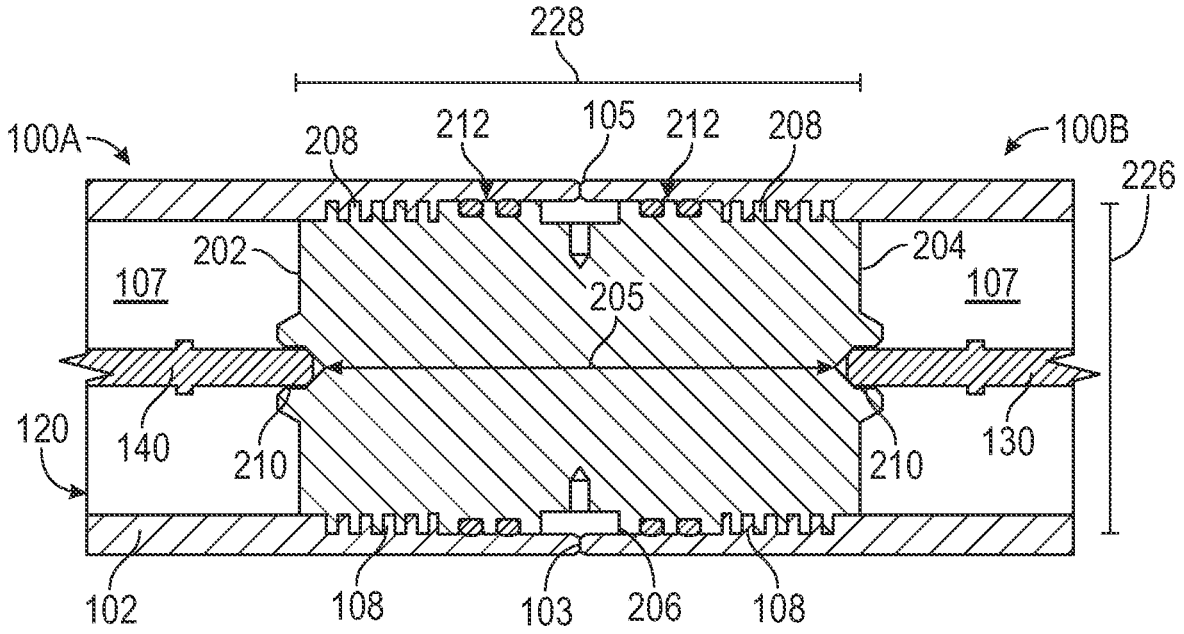
FIG. 4 is an enlarged fragmentary cross-sectional side view of the solid signal puck of FIG. 2.

The gun housings 102 of the perforating guns 100A and 100B are shown not only connected end-to-end in FIGS. 2-4, but in physical end-to-end contact at their respective ends 103 and 105 to enable electrical communication from one gun housing 102 to the next. In other words, while the gun housings 102 are connected end-to-end with another tool or another gun, they may not be in actual physical contact with the adjacent tool in all embodiments as the connection may include other elements to secure the adjacent tools together and the same or different elements to provide electrical communication. As will be discussed extensively herein, the gun housings 102 of perforating guns 100A and 100B are connected end-to-end with a solid signal puck 200 providing at least a pressure resistant barrier and electrical communication but also preferably providing a fluid seal to keep an interior void space 107 in each gun protected from wellbore fluids that may compromise the eventual detonation of the guns. So, for this first embodiment, an end-to-end connection includes direct end-to-end connections in which direct physical contact is made between the end-to-end connected members and end-to-end connections where the gun housings are spaced apart by elements or components that relate to the connection of a gun housing 102 with an adjacent tool.

In this exemplary embodiment, the charge carrier 120 of each of the perforating gun 100A and 100B generally includes a charge tube 122 with a first or uphole electrical connector 130 and a second or downhole electrical connector 140. It should be understood that the term "electrical connector" used herein is broadly construed as including a variety of types of connectors used to form an electrical connection including, for example, pins, wires, recesses, cup-shaped indentions and even off-center connectors such as a radial ring or brush connector, etc. The electrical connectors 130 and 140 connect to a signal puck 200 as will be described and explained below. The uphole electrical connector 130 is coupled to a first or uphole end of charge tube 120 while the downhole electrical connector is coupled to a second or downhole end of the charge tube 120 opposite the uphole end of charge tube 120. In this exemplary embodiment, charge carrier 120 includes a plurality of explosive shaped charges 124 received in the charge tube 122 thereof. While this described exemplary embodiment has the charge carrier 120 include explosive charges 124, in other embodiments, the charge carrier 120 may include other types of energetic mechanisms for forming perforations in a casing or liner string such as directed electric pulses, lasers or other means for puncturing the casing 12. Each explosive charge 124 is oriented generally radially outward towards the gun housing 102 but may also be oriented upwardly in the horizontal run, downwardly, or to the side. Moreover, adjacent charges may be arranged to have phased orientations relative to one another being 180 degrees different, 120 degrees different, 90 degrees different and any other phase differences as may be desired. The charge tube 122 is configured to couple with and house each explosive charge 124 and, when signaled from the surface, detonate the explosive charges 124 to perforate the gun housing 102 and casing 12.

As is generally conventional in perforating system, an overall tool string electric circuit is formed which extends from the surface assembly 11 through the wireline cable 22 and on to and through each of the perforating guns and most other tools in the tool string 20. In particular, the wireline cable 22 includes at least one positive and one negative wire where signals and power are directed down a positive wire to be returned back through a negative wire thereby forming a completed circuit. In this explanation, the negative wire may also be described as a ground wire and the positive wire may be described as a signal or power wire.

As is also generally conventional, each of the perforating guns and most other tools in the tool string include their own electrically conductive pathways for the positive side and negative side of the electric circuit essentially forming a number of parallel circuits within the overall tool string electric circuit through the various guns and tools. The general design paradigm for the tools and guns is to use the housing or periphery as part of the ground side of the circuit and a more internal pathway, that is electrically insulated from the ground side, for the positive side of the circuit. In the present disclosure, the positive side of the electric circuit within each gun is not shown per se, but extends between each of the electrical connectors 130 and 140 while the gun housing is part of the ground side of the electric circuit and is accessed by the charge carrier 120 via ground contacts 128.

In this first exemplary embodiment, each of the electrical connectors 130 and 140 are formed as an electrical contact pin extending from the ends of the charge carrier 120. However, it should be understood that the configuration of electrical connectors 130 and 140 may vary in other embodiments as described above. Electrical connectors may also be longitudinally translatable relative to charge carrier 120 in some embodiments such as having a spring-loaded arrangement to adjust or accommodate jolts while being run downhole, or when the frac plug 60 is set, or when the perforating guns 100A and 100B are fired, or simply to accommodate thermal expansion or contraction or other imperfections between the charge carrier 120 and the pucks 200 at either end of the gun housing 102.

Each perforating gun preferably uses the signals and power coming in to the perforating gun at the uphole electrical connector 130 in its operation by forming a completed circuit path to the gun housing 120 but, in parallel, must also pass the signals and power on to the next perforating gun or tool in the tool string via the downhole electrical connector 140. The completed circuit path for each gun includes a switch such as an addressable switch that interprets signals received from the surface 5 to selectively enable power to pass to a detonation system circuit within the perforating gun to initiate detonation of the explosive charges 124. It should be understood that both the signals and the electric power are preferably supplied through one common circuit but separate circuits may be an option for a tool string with signals conducted separately from the electric power. Preferably in operation, signals that are unique and distinctive for each operable tool in the tool string are sent to all of the tools via the parallel circuits but where only one addressable switch reacts to its authentic signal. For the perforating guns, the switch therein responds to its authentic signal by enabling electric power to pass from the uphole electrical connector 130 to the detonator circuit. Power going into the detonator circuit initiates a detonation process where the detonator converts electric power to an explosive or ballistic energy. The detonator is physically arranged with det cord to quickly pass the explosive or ballistic energy released by the detonator to the det cord to undertake its own explosive or ballistic energy release. The det cord is itself arranged and positioned to extend to all of the shaped charges 124 in the perforating gun such that when the det cord release explosive or ballistic energy to the shaped charges 124, those shaped charges 124 undertake their own release of explosive or ballistic energy. This quickly progressing process results in the firing of the perforating gun. It should be understood that the foregoing description is only exemplary and the explosive charges of perforating guns and may be triggered via other mechanisms.

Referring still to FIGS. 2-4 and especially FIG. 4, a solid signal puck 200 is generally configured to accomplish two competing functions. The first is to communicate electrical signals therethrough from at least one perforating gun to the next tool or next perforating gun. The second is to provide a pressure barrier for each gun or tool and the components inside the gun housing 102 from being functionally compromised by explosive forces or by breaching of the air-filled interior void space within the gun housing letting wellbore fluids such as salt water or drilling fluids inside that may short circuit the addressable switch or other components of the electric circuit inside a gun that was yet to be fired. Fluid intrusion can also compromise the explosive charges. If intrusion of salt water, drilling fluids, or other incompressible fluids does not compromise the explosive charges and electrical system, and the gun is fired, the gun housing 102 will severely fracture by possibly severing the tool string or by anchoring the tool string 20 to the inside wall of the casing 12, or both. Either of these results are undesirable so it is an important function of the solid signal puck 200 to keep fluids out of the interior void space 107 of the perforating guns 100A and 100B.

Typically, the process of getting the tool string to the bottom of the wellbore can include significant shock loads and vibrations. The setting of the plug can involve particularly violent jarring forces. Finally, as each gun is fired (often independent of the firing of other guns) there are further pressure pulses and jarring of the tool string. Through all of these circumstances, the guns need to be protected to preserve their reliability for eventual firing. In addition to providing a pressure barrier, the solid signal puck 200 itself preferably seals the open ends 103 and 105 of the gun housing 102 to close and define the interior void space therein.

In this first particular exemplary embodiment, the solid signal puck 200 generally includes a first or uphole endface 202, a second or downhole endface 204 at the opposite end or longitudinally opposite the uphole endface 202, and an outer periphery 206 extending between endfaces 202 and 204. Notably, the solid signal puck 200 is devoid of any throughhole in any orientation and particularly from the uphole endface 202 through to the downhole endface 204. Additionally, in this first exemplary embodiment, each endface 202 and 204 is shown to be generally planar. It should be understood that the end configuration of the endfaces 202 and 204 may have a different and more complicated shape including convex and concave portions with ring like ridges or grooves as needed or desired. Ultimately, a shorter length of solid signal puck 200 between the endfaces is generally preferred in that a shorter puck makes for shorter tools that thereby permits more tools in a tool string. More tools in every tool string generally translates to less runs and therefore less time creating perforations and thereby less total cost for a producing hydrocarbon well.

In this first exemplary embodiment, the end portions of the solid signal puck 200 includes outside threads 208 along the outer periphery 206 where each end is received and connected to the ends of the respective gun housings 102. The solid signal puck 200 further includes O-rings 212 for sealing against the inside surface of the gun housings 102 closing the respective ends of the tubular gun housings 102. As seen in FIGS. 3 and 4, the solid signal puck 200 only extends partially inside each of the gun housings 102 and the guns are secured to one another by the respective screw threads 108 and 208. Alternative sealing arrangements may be suitable such as one or more plastic coatings and a tight interference fit where the puck is inserted with the help of a tool and jig.

At least a portion of each endface 202 and 204 solid signal puck 200 is electrically conductive while the outer periphery 206 of solid signal puck 200 is electrically insulated so that the positive and ground circuits are electrically separated. In this exemplary embodiment, the endfaces 202 and 204 of solid signal puck 200 includes a recess or cup-shaped portion 210 for engaging each of the electrical connectors 130 and 140, as shown. For example, the recess 210 on the uphole endface 202 engages or receives the pin shaped electrical connector 140 of the downhole electrical connector 140 of the uphole perforating gun 100A. Similarly, the recess 210 of downhole endface 204 engages or receives the pin shaped uphole electrical connector 130 of the downhole perforating gun 100B. In this manner, an electrical signal pathway (identified by double-end arrow 205 in FIG. 4) may be formed between electrical connectors 140 and 130 of perforating guns 100A and 100B, respectively. The signal pathway 205 extends entirely between the uphole endface 202 and the downhole endface 204 of solid signal puck 200. However, signal pathway 205 does not contact or intersect an inner surface of gun housing 102. The solid signal puck 200 is formed from an electrically conductive material such as steel or a metal alloy or the like and may include an insulating outer surface 206.

The outer periphery 206 of the puck along the outer surface thereof is electrically insulated from the gun housing 102 of both perforating guns 100A and 100B. In some embodiments, the electrically insulation may be a coating, an overmolded material (plastics, elastomers, and/or non-conductive metallic materials), a chemically or electrically modified surface, an anodized material, or an additive manufactured material. In some embodiments, the outer periphery 206 of solid signal puck 200 is defined by an electrically insulating material. In other embodiments, the outer periphery 206 of solid signal puck 200 may be electrically conductive while at least a portion of an inner surface of gun housing 102 is electrically insulating. For example, in some embodiments, an electrically insulative coating may be applied to the interior of gun housings 102 of both perforating guns 100A and 100B and the puck may or may not include an electrically insulative coating.

One particular aspect of the solid signal puck 200 is the size and shape thereof and particularly the large diameter. It is mechanically advantageous to design pressure bearing surface with a small cross-section to reduce the effective magnitude of a pulse or blast. In contrast, the solid signal puck 200 is preferably large to fill the open end of the tubular gun housing 102. To handle the anticipated forces, the solid signal puck 200 is made of strong material (preferably steel) with sufficient thickness or length between the endfaces to bear the load. This leads to a solid signal puck to have a relatively large diameter to length ratio where the first embodiment is the smallest diameter to length ratio of all the disclosed embodiments. In this first embodiment, the diameter is approximately 40% of the length exclusive of any appendages that may be added to the end faces of the puck 200. It is noted that the pucks are not generally smooth periphery designs as they may have shoulders for bracing against other structures and grooves for holding O-rings and even threads as shown at 208. So, it is seen that the outer periphery 206 of solid signal puck 200 will have a maximum or largest diameter while solid signal puck 200 has a largest or maximum length 228 extending between endfaces 202 and 204. In this first exemplary embodiment, the largest diameter of solid signal puck 200 is at least 40% of the largest length 228 of solid signal puck 200. However, in other embodiments, the largest diameter 226 of solid signal puck 200 may be greater than 40% of the largest length 228. For example, in other embodiments, the largest diameter may be greater than 50% of the largest length 228 or 75% of the length, 100% of the length and even greater ratios up to, for example, 125% of the maximum length 228 between the endfaces 202 and 204. In the embodiments, the solid signal puck has a largest diameter of at least ¾ of an inch and may be formed in various diameters including 1.5 inches, 2 inches, 2.5 inches and even 3 inches or larger in diameter.

As described above, the length of the solid signal puck 200 is preferably kept short while still within design limits for anticipated maximum pressure pulse and strength of the materials of the puck 200 and other connecting structure. In other words, by minimizing a length of solid signal puck 200, the effective lengths of the perforating guns may enable one or more guns to be installed in a tool string 20 getting more effectiveness from each trip of a tool string 20 into the wellbore 4.

Figure 5:
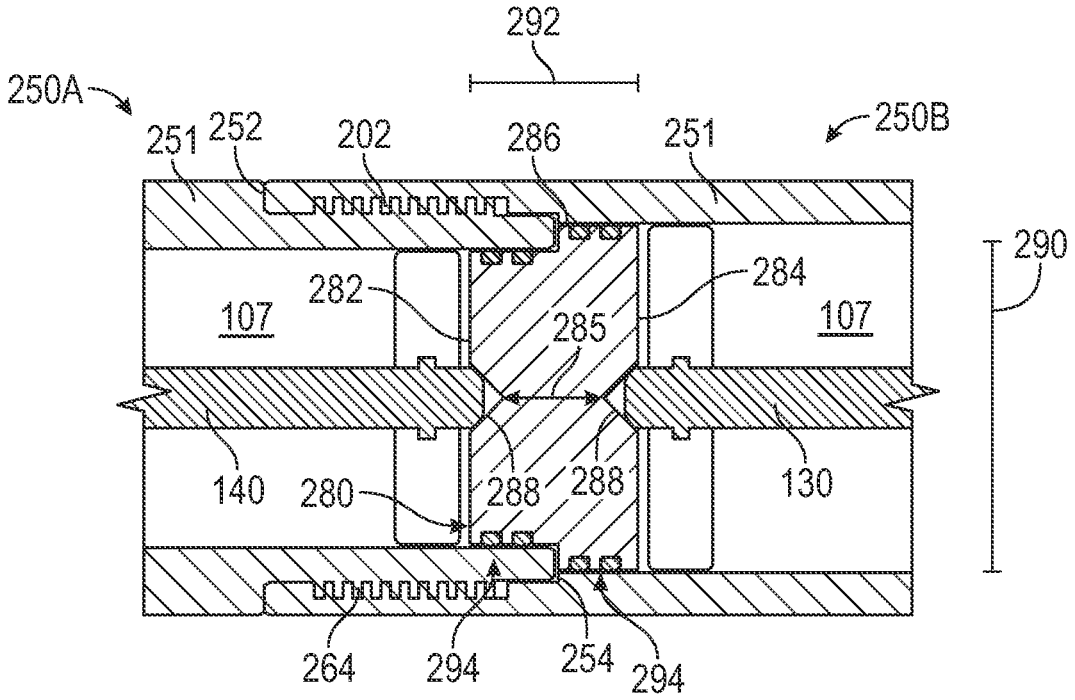
FIG. 5 is a fragmentary cross-sectional side view of a second embodiment of a solid signal puck for physically protecting and electrically connecting a perforating gun.

Referring now to FIG. 5, a second embodiment will be described where perforating guns 250A and 250B are connected end-to-end using a closure or solid signal puck 280. The perforating guns 250A and 250B include many features of the perforating guns 100A and 100B and the solid signal puck 280 include similar features of the solid signal puck 200. Common or shared features are labeled similarly. Each of the perforating gun 250A and 250B include a gun housing 251 and charge carrier 120. Like the solid signal puck 200 shown in FIGS. 2-4, solid signal puck 280 is configured to electrically connect and provide bi-directional pressure isolation between perforating guns 250A and 250B.

The gun housing 251 of each perforating gun 250A and 250B includes an open first or uphole end 252, an open second or downhole end 254 longitudinally opposite uphole end 252, a central bore or passage forming an interior void space 107 within which charge carrier 120 is received. In this second arrangement the gun housings 251 are connected end-to-end in a pin-by-box arrangement where each gun housing 251 includes an internal uphole connector 262 and an external downhole connector 264 where the ends of the gun housings 251 overlap when connected. In this exemplary embodiment, uphole connector 262 comprises a threaded "pin" connector while the downhole connector 264 comprises a threaded box connector. In this configuration, the box connector 264 of downhole perforating gun 250B directly connects to the pin connector 262 of the uphole perforating gun 250A. In this manner, solid signal puck 280 is in the end-to-end connection but does not secure the gun housings 251 to one another. The solid signal puck is more accurately trapped or "sandwiched" between the two charge carriers 120.

In this second exemplary embodiment, the solid signal puck 280 generally includes a first or uphole endface 282, a longitudinally opposite second or downhole endface 284, and an outer periphery 286 extending between the endfaces 282 and 284. While this exemplary embodiment is described with an uphole and downhole orientation, it is reasonable to expect that the orientation could be reversed and still work well in operation. It is emphasized that the solid signal puck 280 is devoid of any throughhole between the endfaces such that the solid signal puck 280 itself defines the electrical signal pathway (identified by double arrow 285 in FIG. 5) from one electrical connector to the other. As in the first embodiment the solid signal puck 280 is electrically insulated from the gun housings 251. The endfaces 282 and 284 similarly include a recess 288 for engaging each of the electrical connectors 130 and 140 of perforating guns 250A and 250B, respectively.

The outer periphery 286 of solid signal puck 280 has a maximum or largest diameter 290 while solid signal puck 280 has a largest or maximum length 292 extending between endfaces 282 and 284. In this exemplary embodiment, the largest diameter 290 of solid signal puck 280 is at least 100% of the largest length 292 of solid signal puck 280. Indeed, in this exemplary embodiment, the largest diameter 290 of solid signal puck 280 is larger than the length 282 thereof.

Similar to the first exemplary embodiment, solid signal puck 280 includes two pairs of annular seal assemblies 294 which are positioned on the outer periphery 286 thereof where one set of O-rings seal on the inside of one gun housing 251 at the larger diameter and a second set of O-rings sealed on the inside of the other gun housing 251 along the smaller diameter outer periphery of the solid signal puck 280. In other embodiments, the configuration of the seal assemblies 294 may vary. And it is noted that while the ends of the gun housings overlap, the connection is still described as end-to-end where the gun housings 251 follow the tool string axis 25 in FIG. 1.

Figure 6:
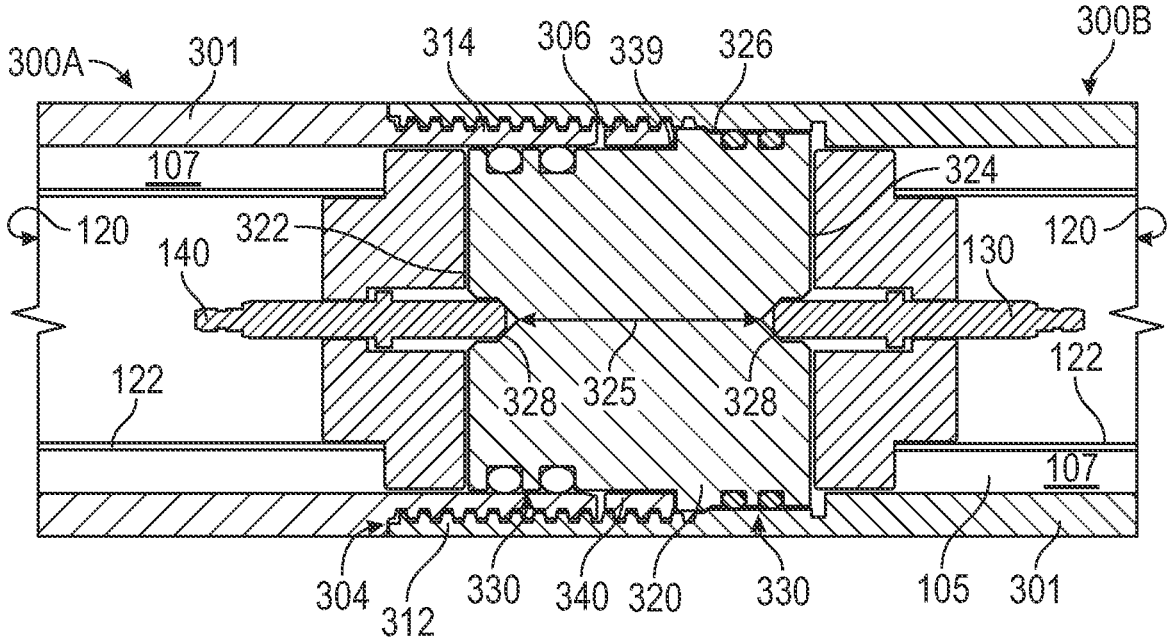
FIG. 6 is a fragmentary cross-sectional side view of a third embodiment of a solid signal puck for physically protecting and electrically connecting a perforating gun.

Turning now to a third exemplary embodiment shown in FIG. 6, perforating guns 300A and 300B are connected end-to-end with a closure or solid signal puck 320 at the connection. Each of the perforating guns 300A and 300B comprises a gun housing 301 and charge carrier 120. A solid signal puck 320 is arranged to electrically connect and provide bi-directional pressure isolation between perforating guns 300A and 300B.

The gun housing 301 of each perforating gun 300A and 300B includes an open first or uphole end 302, an open second or downhole end 304 longitudinally opposite uphole end 302, a central bore or passage defining an interior void space 107 where charge carrier 120 is positioned. Gun housings 301 are connected end-to-end in a box-by-pin arrangement where each gun housing 301 includes a threaded internal or "box" connector 312 at the uphole end and a threaded external or "pin" downhole connector 314 at the downhole end. In this configuration, the pin connector 314 of uphole perforating gun 300A directly connects to the box connector 312 of the downhole perforating gun 300B in an overlapping arrangement with solid signal puck 320 between the charge carriers 120 again in a trapped or "sandwiched" arrangement.

In this exemplary embodiment, solid signal puck 320 generally includes a first or uphole endface 322, a longitudinally opposite second or downhole endface 324, and an outer periphery 326 extending between the endfaces 322 and 324. While this exemplary embodiment is described with an uphole and downhole orientation, it is reasonable to expect that the orientation could be reversed and still work well in operation. For emphasis, the solid signal puck 320 is devoid of any throughhole in any orientation and particularly extending between endfaces but instead defines an electrical signal pathway (identified by double arrow 325 in FIG. 6) which extends between electrical connectors 140 and 130. The recesses 328 are electrically conductive while the outer periphery 326 is electrically insulated from the gun housings 301. And, like the previous embodiments, the outer periphery 326 has a maximum or largest diameter that is greater than 40% of a maximum or largest length of solid signal puck 320 between the endfaces not including any projections added to the endfaces. Also similar to prior explained embodiments, the solid signal puck 320 includes two pairs of annular seal assemblies 330 which are positioned on the outer periphery 326 thereof where one pair engages the inside surface of the one gun housing and the other pair engage the insider surface of the other gun housing 301. In this exemplary embodiment, each seal assembly 330 comprises a pair of O-ring seals. In other embodiments, the configuration of the seal assemblies 330 may vary.

This third embodiment shown in FIG. 6 additionally includes a stop ring 340 positioned inside and connected to the box connector 312 with and by threads but spaced from the end 306 of the pin connector 314. In this arrangement, stop ring 340 may be engaged by puck shoulder 339 upon detonation of the explosive shaped charges in perforating gun 300B. Stop ring 340 prevents the puck shoulder from slamming into and impairing the pin connector 314 in a manner that complicates disassembling of the tool string after the tool string has been pulled from the wellbore 4. While this exemplary embodiment is described with an uphole and downhole orientation, it is reasonable to expect that the orientation could be reversed and still work well in operation.

Figure 7:
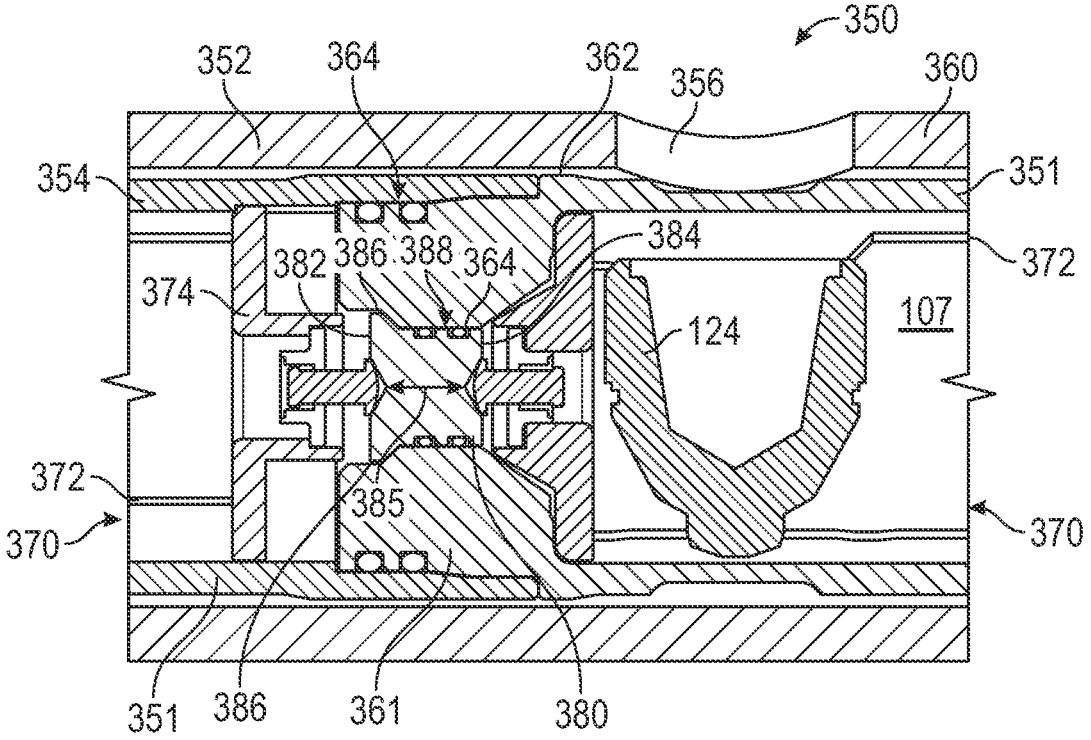
FIG. 7 is a fragmentary cross-sectional side view of a fourth embodiment of a solid signal puck for physically protecting and electrically connecting a perforating guns

Turning now to the fourth embodiment shown in FIG. 7, modular perforating gun 350 includes one or more gun housings 351, an outer sleeve 360, a charge carrier 370 and a closure or solid signal puck 380. The gun housings 351 are connected end-to-end within outer sleeve 360. The gun housings 351 are generally tubular but have a nesting design where one end of each gun housing 351 is sized to be inserted into the opposite end of the next adjacent gun housing 351 in a sealing arrangement. Within the gun housing 351 at the inserted end, the solid signal puck 380 is positioned to seal against the inside of the gun housing and close and seal the interior void space 107. The solid signal puck 380 further defines an electrical signal pathway (identified by double arrow 385 in FIG. 7). A snap ring (not shown) is preferably installed at the end of the inserted end of the gun housing 351 to hold the puck from moving out of the gun housing. In alternative embodiments, the signal puck 380 may be secured to the gun housing 351 using a threaded retainer. This is the smallest diameter solid signal puck embodiment that is disclosed but still has a diameter to length ratio of close to 1:1 or 100%. The end faces of the puck include recesses for pin shaped electrical connectors to direct electrical signals and electric power through the solid signal puck 380 from one gun to an adjacent gun. This arrangement is interesting in that the outer sleeve includes openings 356 aligned with each shaped charge 124 so the thickness is not limited. The thickness dimension can be quite a bit more substantial as it will not comprise the power in the perforating gun as other embodiments might but is suitable for enduring the tensile forces that may be imposed on the tool string after all the guns are detonated and the tool string is deformed in ways that drag heavily against the inside of the casing 12. The gun housing 351 is formed with a thickness only focused on protecting the interior void space from rupture which may be quite a bit thinner than other gun housings described. So, in this arrangement, each puck 380 seals against the inside of one gun but is still involved with closing and sealing the interior void space of the connected perforating gun.

As with other embodiment, each perforating gun housing 351 includes a charge carrier 370 and sealed via an annular seal assembly 364 comprised of a pair of O-rings positioned on an outer periphery of the gun housing 351 while the annular seal assembly 388 seals the puck 380 to the inside of the inserted end of the gun housing 351. The solid signal puck 380 like the other embodiments provides an electrical connection between guns and also provides bi-directional pressure isolation for adjacent guns from all pressure pulses and other potentially comprising events downhole.

Figure 8:
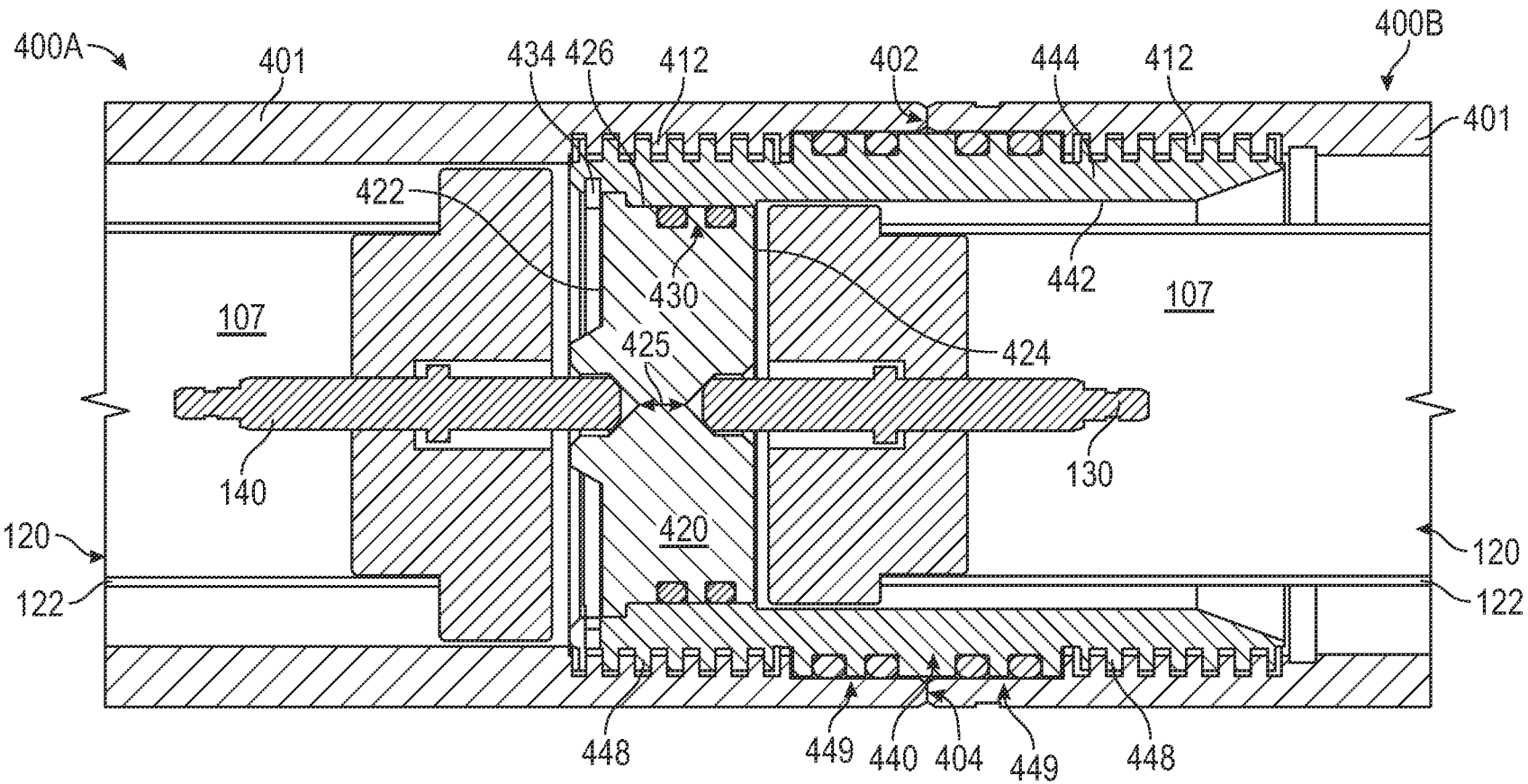
FIG. 8 is a fragmentary cross-sectional side view of a fifth embodiment of a solid signal puck for physically protecting and electrically connecting a perforating gun.
Figure 9:
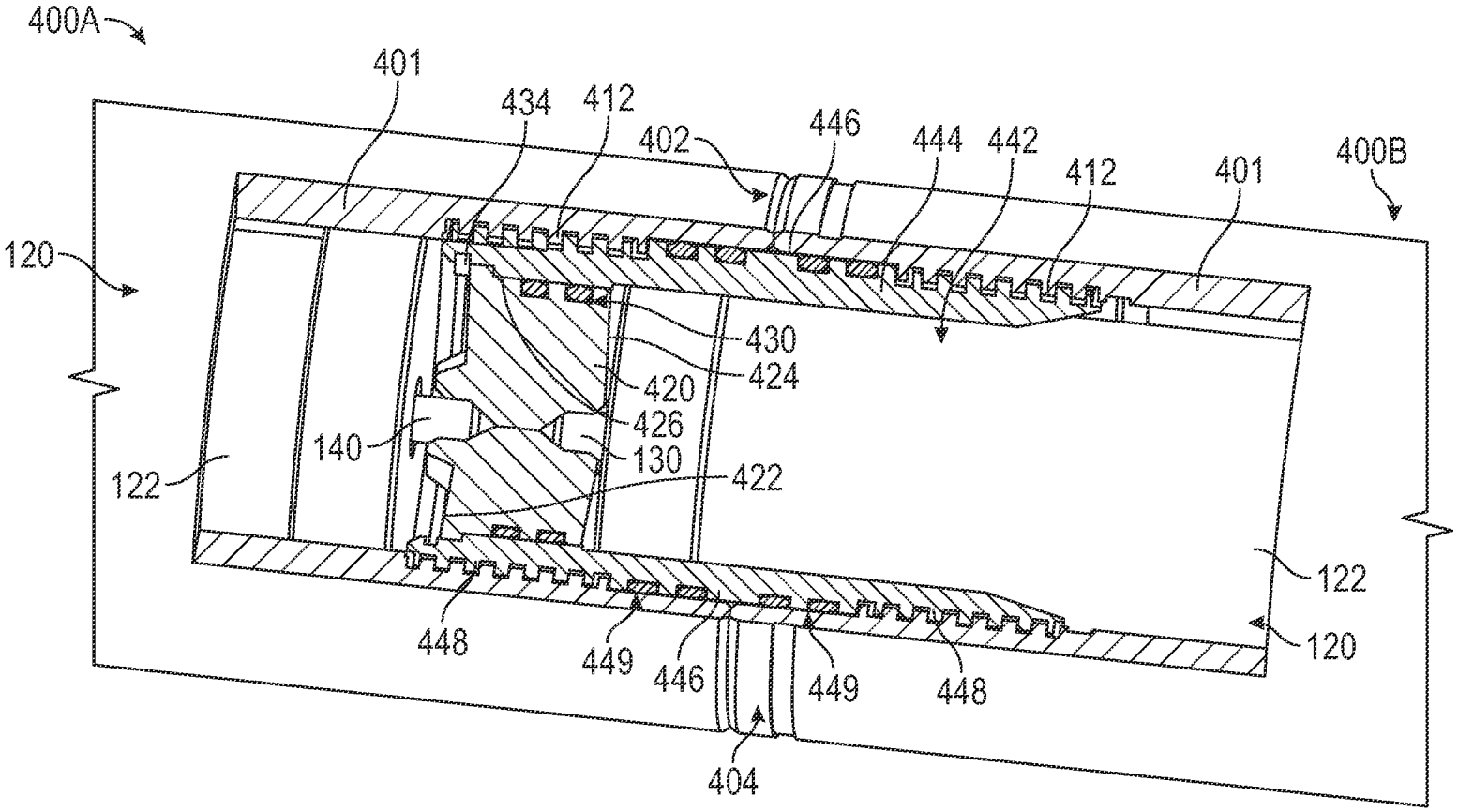
FIG. 9 is a perspective view with a quarter cross-section cut away of the fifth embodiment of the solid signal puck and the perforating guns of FIG. 8.
Figure 10:
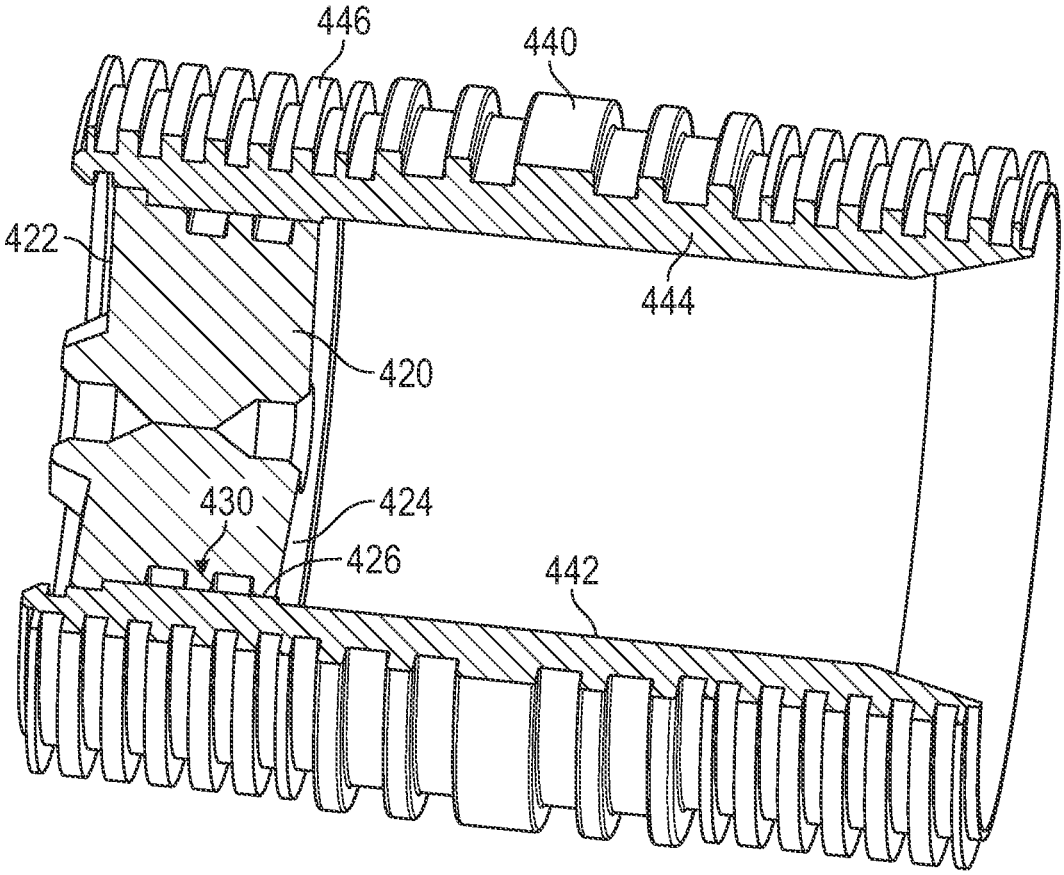
FIG. 10 is a perspective view of the fifth embodiment of the solid signal puck and an embodiment of a coupler where a quarter cross-section is cut away.

Referring to a fifth embodiment shown in FIGS. 8-10, perforating guns 400A and 400B are connected end-to-end with a coupler 440 and a closure or solid signal puck 420. Each of the perforating guns 400A and 400B comprises a gun housing 401 and charge carrier 120. Like other described solid signal pucks, solid signal puck 420 is configured to electrically connect and provide bi-directional pressure isolation between perforating guns 400A and 400B. The gun housing 401 of each perforating gun 400A and 400B includes an open first or uphole end 402, an open second or downhole end 404 longitudinally opposite uphole end 402, a central bore or passage creating an interior void space 107 and where charge carrier 120 is positioned. The charge carrier 120 includes charge tube 122 and pin shaped electrical connectors 130 and 140. In this fifth exemplary embodiment, the gun housings 401 each include threaded internal or "box" connectors 412 which are connect to the external or pin connectors 448 on the outside of the internal coupler 440. The internal coupler 440 is generally tubular having a central bore or passage defined as being within an inside surface 442. External connectors 448 are threadably connected to the internal connectors 412 of the gun housings 401 to thereby form an end-to-end connection of the gun housings 401. The internal coupler 440 further comprises a pair of annular seal assemblies 449 each comprised of two O-rings positioned along the outer periphery 446 and sealing against the inside walls of the respected connected guns. In other embodiments, the configuration of the seal assemblies 449 may vary. This internal coupler 440 tends to provide a strong and secure connection with substantial overlapping threads engaging each of the gun housings.

The solid signal puck 420 is within the end-to-end connection but does not carry any tensile or compressive load of the tool string but seals against the inside of the internal coupling. Like other exemplary embodiments, solid signal puck 420 generally includes a first or uphole endface 422, a longitudinally opposite second or downhole endface 424, and an outer periphery 426 extending between the endfaces 422 and 424. While this exemplary embodiment is described with an uphole and downhole orientation, it is reasonable to expect that the orientation could be reversed and still work well in operation. For emphasis, the solid signal puck 420 is devoid of any throughhole in any orientation and particularly between the endfaces 422 and 424. The solid signal puck 420 further defines an electrical signal pathway (identified by double arrow 425 in FIG. 8) which extends between electrical connectors 140 and 130. And like other described pucks, is electrically insulated from the gun housings 401. Additionally, the outer periphery 426 of solid signal puck 420 has a maximum or largest diameter that is at least 40% of a maximum or largest length of solid signal puck 420. A pair of annular seal assemblies 430 positioned on the outer periphery 426 of the solid signal puck 420 seal against the inside of the coupler 440 and this comprises a pair of O-ring seals. In other embodiments, the configuration of the seal assemblies 430 may vary. Seal assemblies 430 sealingly engage or contact the outer wall 444 of internal coupler 440, thereby sealing the connection formed between solid signal puck 420 and the internal coupler 440. Like the previously described exemplary embodiment, the solid signal puck 420 is retained to the internal coupler 440 by a retainer ring (e.g., a C-ring or a snap ring) 434 that fits into a corresponding groove formed in the inside of the outer wall 444 of the internal coupler 440. In some alternative embodiments, the signal puck 420 may be secured to the internal coupler 440 using a threaded retainer. In some embodiments, solid signal puck 420 may be pre-assembled with internal coupler 440 using a retention mechanism such as retainer ring 434. The assembly comprising the solid signal puck 420 and internal coupler 440 may then be assembled with perforating guns 400A and 400B in the field at the location of a wellbore (e.g., wellbore 4 shown in FIG. 1).

Figure 11:
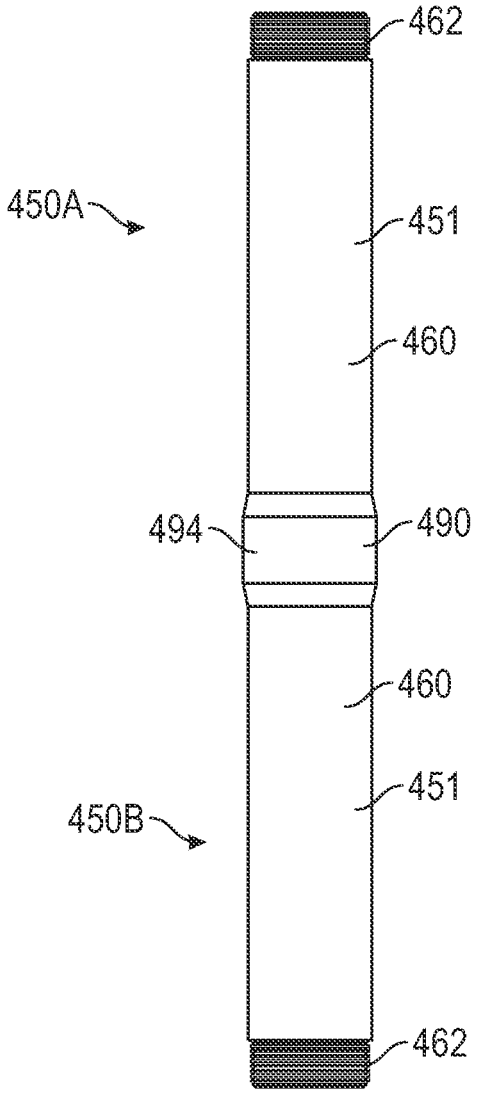
FIG. 11 is a side view of a sixth embodiment of a solid signal puck for physically protecting and electrically connecting a perforating gun.
Figure 12:
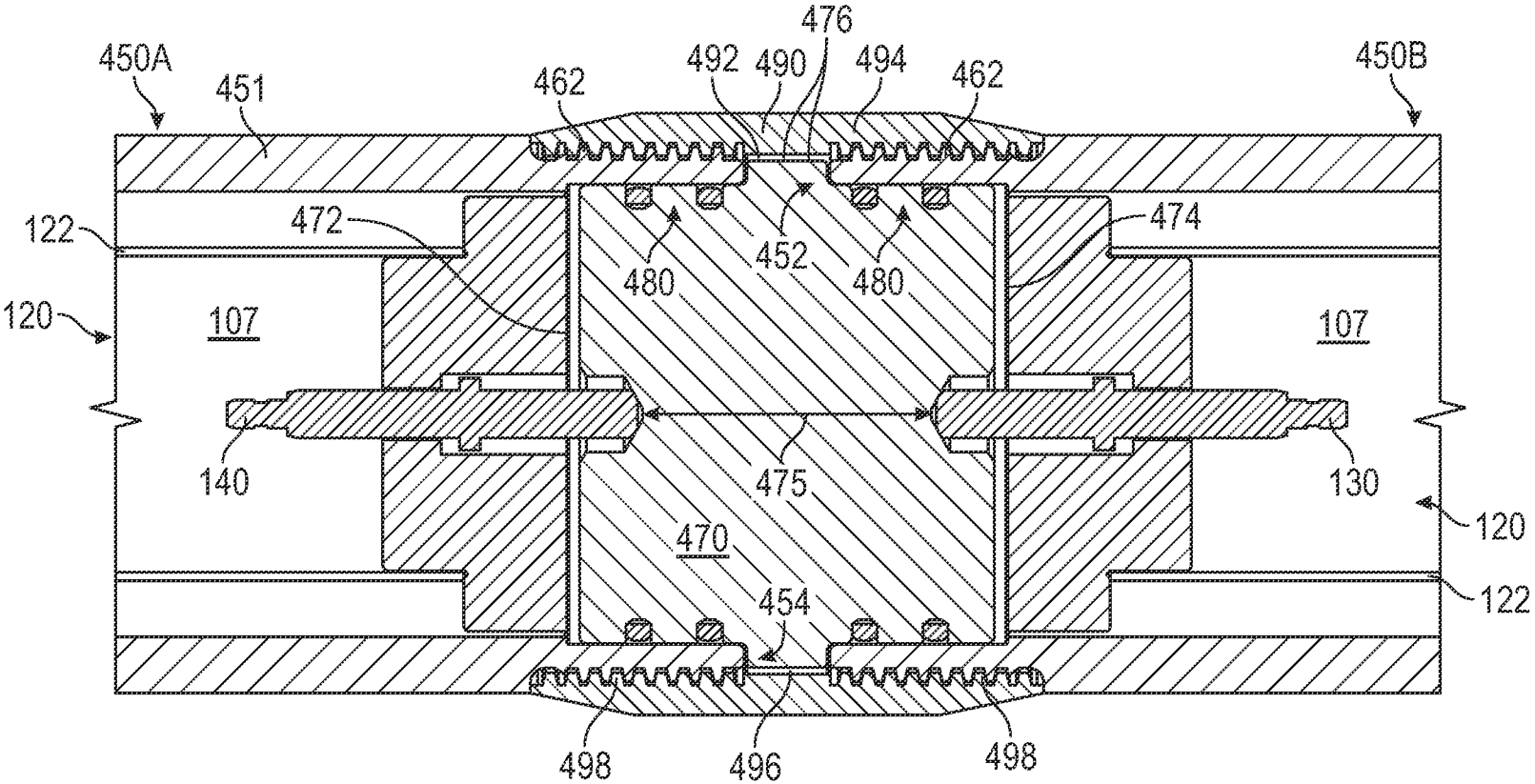
FIG. 12 is an enlarged fragmentary cross-sectional side view of the sixth embodiment of the solid signal puck with a pair of perforating guns.

Turning now the sixth described embodiment shown in FIGS. 11 and 12, perforating guns 450A and 450B are securely connected in and end-to-end arrangement with an external coupler 490 and a closure or solid signal puck 470 arranged to provide electrical connection and bi-directional pressure protection or isolation. Each perforating gun 450A and 450B comprises a gun housing 451 and charge carrier 120 where each gun housing 451 includes an open first or uphole end 452, an open second or downhole end 454 longitudinally opposite uphole end 452, a central bore or passage defining an interior void space 107 where the charge carrier 120 is positioned. While this exemplary embodiment is described with an uphole and downhole orientation, it is reasonable to expect that the orientation could be reversed and still work well in operation. Gun housings 451 are connected end-to-end with an annular external coupler 490. Unlike the internal coupler 440 described above, the external coupler 490 overlies the gun housings and thus no portion of the external coupler 490 is received within the interior void space 107. In this arrangement, the gun housings 451 of each perforating gun 450A and 450B includes a pair of threaded external or "pin" connectors 462 which connect to the external coupler 490. The external coupler 490 is generally tubular having a central bore or passage 492 with an inner periphery 496 along with a generally cylindrical outer wall 494 having sloped ends to avoid catching on casing joints or other surface irregularities downhole. The external coupler 490 includes a pair of threaded internal connectors 498 positioned on the inner periphery 496. Internal connectors 498 may threadably connect to the internal connectors 462 of the gun housings 451 to thereby form an end-to-end connection. It is noted that external coupler 490 is not shown to seal against the gun housings 451 of perforating guns 450A and 450B but sealing within the external coupler is not precluded and may be an optional arrangement. While the external coupler is believed to be a strong and secure connection, one of the advantages of this arrangement is that the external couplers lift the gun housings off the casing and may reduce friction going up and down the hole which may speed up tripping the wireline tools in and out of the wellbore 4. Another advantage of the reduction in surface friction is improved orientation with eccentric weight bars. Also, the external coupler 490 provides some centralization of the perforating guns 450A and 450B within the casing 12 to promote equal size of charge entry holes through the casing 12. A further potential advantage of the external coupler 490 is the option reduce the depth of any scallops in the gun housing 451 or avoid having any scallop at all. Scallops are common to minimize burrs on the spend guns that might catch on a casing joint or other irregularity inside the wellbore. Having the standoff created by the external coupler 490 will likely reduce hazards created by burrs against the inside surface of the casing 12.

Solid signal puck 470 is not connected end-to-end with the gun housings 451 of perforating guns 450A and 450B and instead is received within the central passage 492 of external coupler 490 and sealed to the gun housings. The solid signal puck 470 generally includes a first or uphole endface 472, a longitudinally opposite second or downhole endface 474, and an outer periphery 476 extending between the endfaces 472 and 474. Solid signal puck 470 is devoid of any throughhole between uphole endface 472 and downhole endface 474. Solid signal puck 470 instead defines an electrical signal pathway (identified by double arrow 475 in FIG. 12) which extends between electrical connectors 140 and 130. The outer periphery of the puck 470 is electrically insulated from the gun housing 451. Additionally, the outer periphery 476 of solid signal puck 470 has a maximum or largest diameter that is at least 40% of a maximum or largest length of solid signal puck 470 and is closer to 100% in this embodiment.

Solid signal puck 470 is trapped between the ends of gun housings 451 although the connection of the guns is characterized as an end-to-end connection. The solid signal puck 470 includes a pair of annular seal assemblies 480 which are positioned on the outer periphery 476 thereof. In this exemplary embodiment, each seal assembly 480 comprises a pair of O-ring seals positioned on the outer periphery 476 of solid signal puck 470. However, in other embodiments, the configuration of seal assemblies 480 may vary. Seal assemblies 480 sealingly engage or contact the inner walls 460 of the gun housings 451 of perforating guns 450A, 450B, thereby sealing the connection formed between solid signal puck 470 and the perforating guns 450A and 450B.

Figure 13:
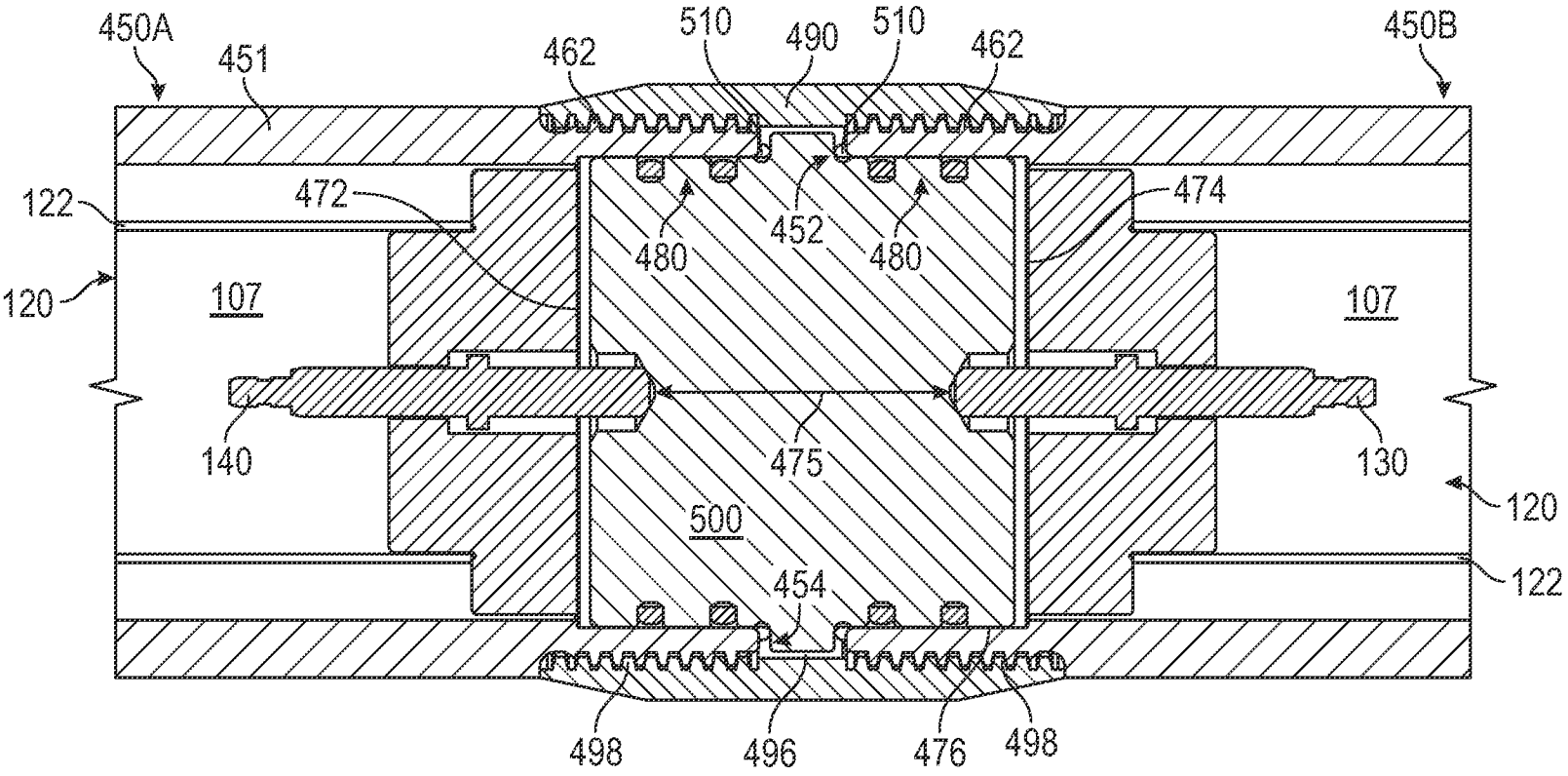
FIG. 13 is an enlarged fragmentary cross-sectional view of a seventh embodiment of a solid signal puck for physically protecting and electrically connecting a perforating gun.
Figure 14:
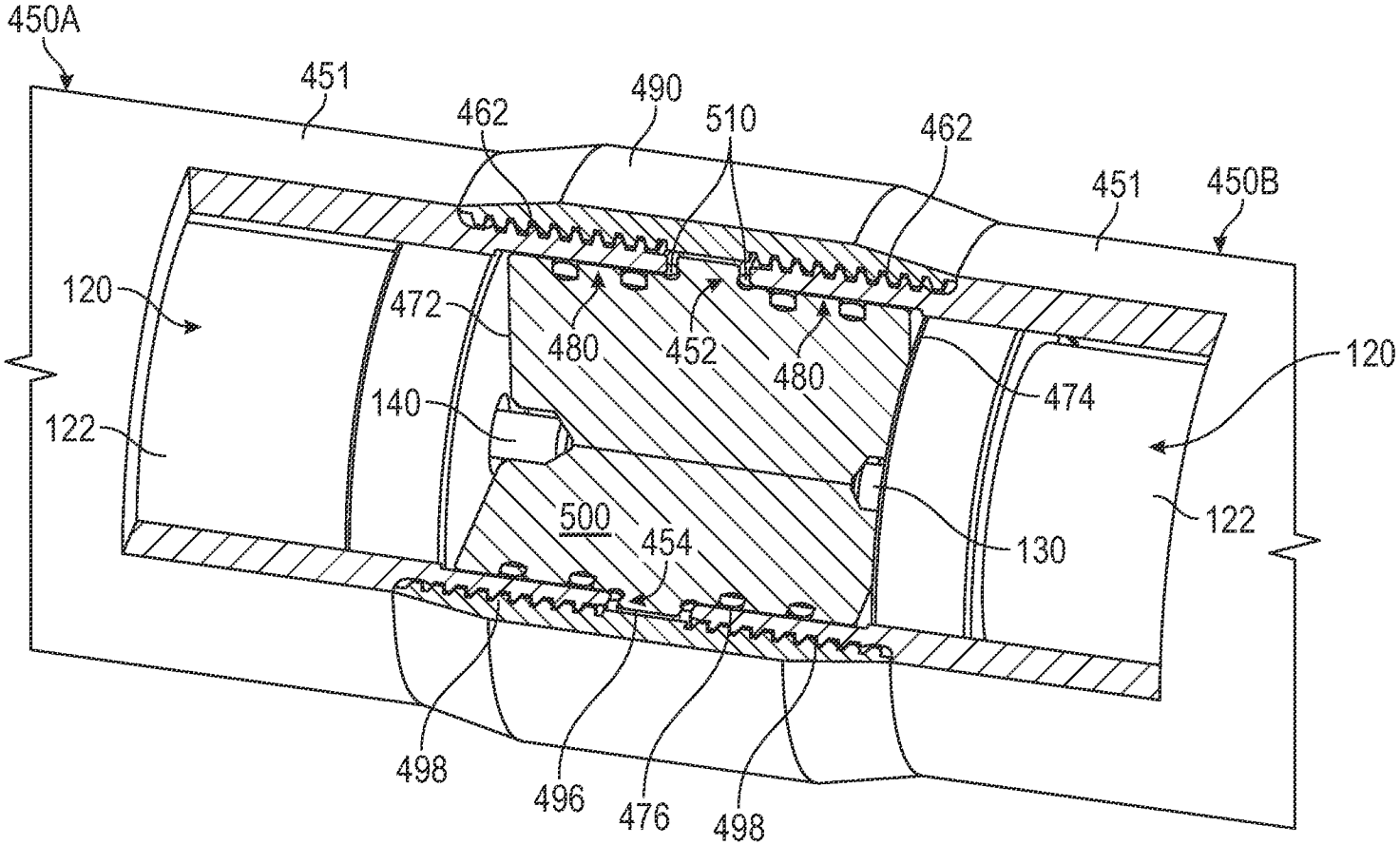
FIG. 14 is an enlarged perspective view of the seventh embodiment of the solid signal puck and perforating guns with a quarter cross-section cut away.
Figure 15:
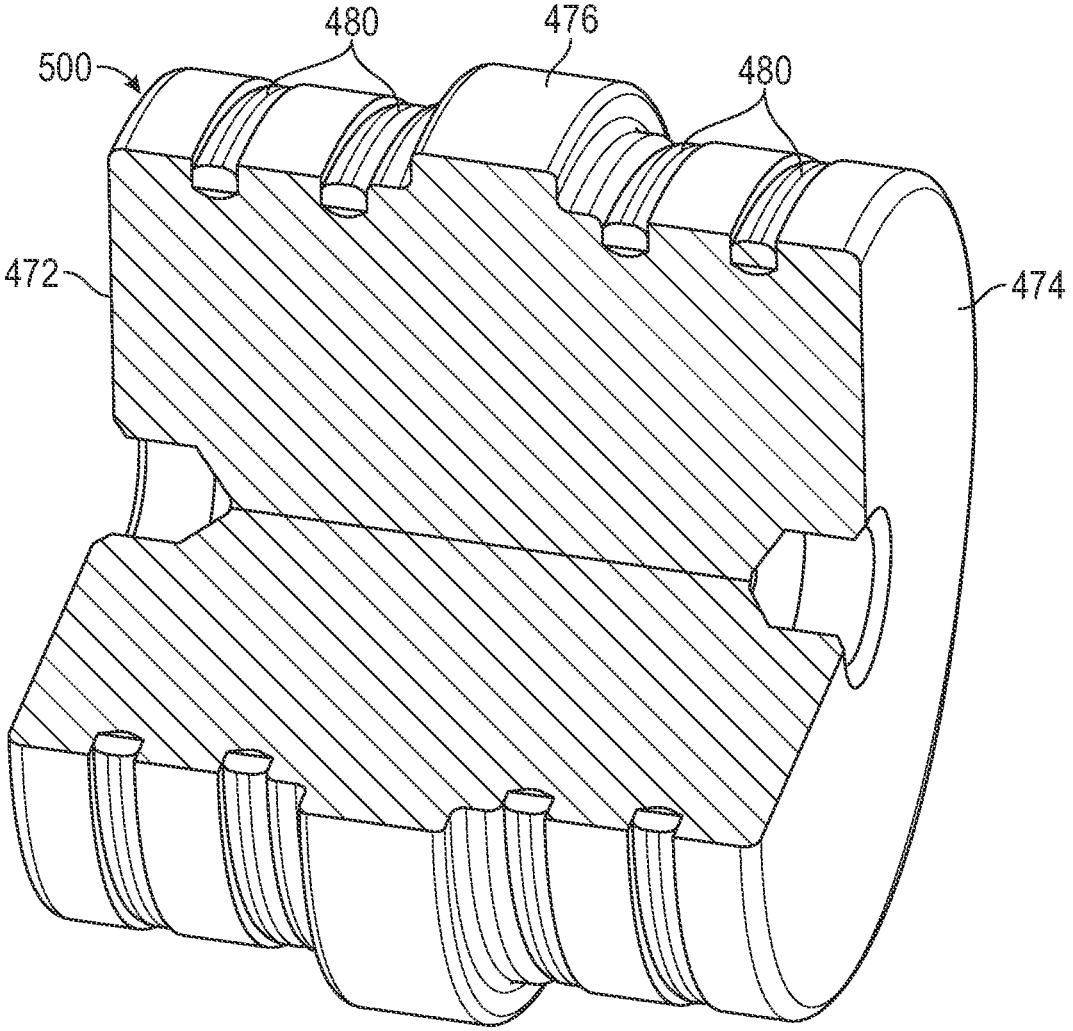
FIG. 15 is a perspective view of an eighth embodiment of the solid signal puck with a quarter cross-section cut away.

Turning now to the seventh described embodiment in FIGS. 13-15, Perforating guns 450A and 450B are connected in an end-to-end arrangement with an external coupler 490 and a closure or solid signal puck 500. This exemplary embodiment is very similar to the previously described embodiment but additionally includes a pair of annular stops 510. A first stop 510 is positioned axially at the uphole end 452 of the gun housing 451 and a puck shoulder on the solid signal puck 500 while a second stop 510 is positioned on the opposite side of the puck shoulder between the downhole end 454 of the gun housing 451 of uphole perforating gun 450A. While this exemplary embodiment is described with an uphole and downhole orientation, it is reasonable to expect that the orientation could be reversed and still work well in operation. The pair of stops 510 may each comprise an elastomeric, composite, plastic, etc. material which protects the outer periphery 476 of solid signal puck 500 from damage as the perforating guns 450A and/or 450B are threaded together. Given that at least a portion of the outer periphery 476 includes an electrically insulating surface, the provision of stops 510 prevent damaging of the electrically insulating surface of solid signal puck 500 to ensure that an electrical short is not formed between solid signal puck 500 and the housings 451 of one of the perforating guns 450A and 450B. An additional advantage of the stops 510 is to perform as a shock absorber to prevent the puck shoulder of solid signal puck 500 from slamming into and impairing the internal connectors 462 in a manner that complicates disassembling of the tool string after the tool string has been pulled from the wellbore 4.

Figure 16:
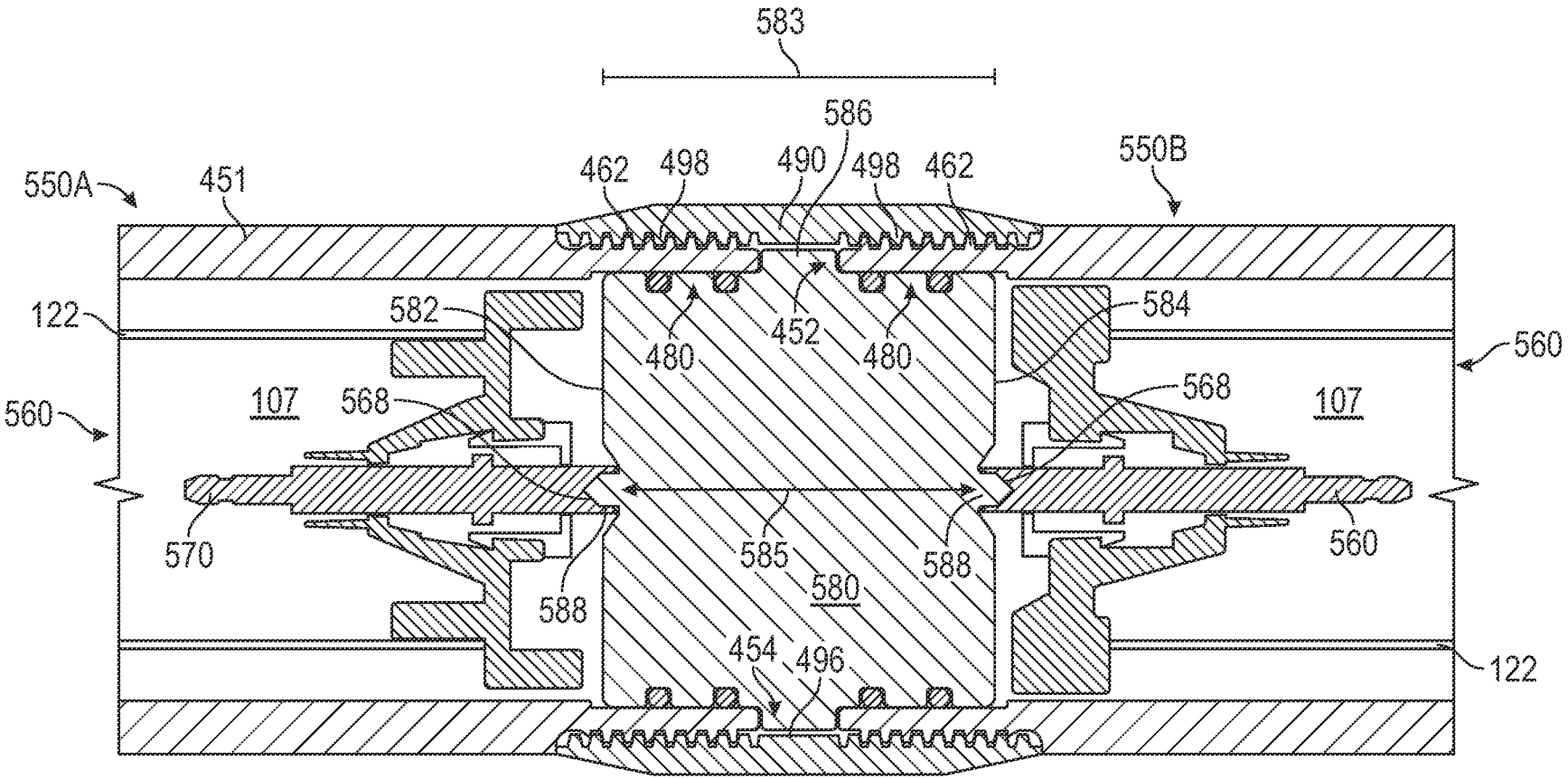
FIG. 16 is an enlarged fragmentary cross-sectional side view of an eighth embodiment of a solid signal puck for physically protecting and electrically connecting a perforating gun.

Turning now to an eighth embodiment shown in FIG. 16, a pair of perforating guns 550A and 550B are connected end-to-end with an external coupler 490 and a closure or solid signal puck 580. As compared to the sixth described embodiment, the electrical connectors 560 and 570 have recesses or cup-shaped or receptacles 568 portions for engaging projections 588 from the end faces of the solid signal puck 580. It may be noted that projections 588 do not form a part of the maximum length 583 of solid signal puck 580 defined by endfaces 582 and 584 of puck 580. It should be understood that the terms "recess" and "receptacle" as used herein is construed broadly as covering recesses/receptacles which are off-line, radial, or otherwise differently configured from the receptacle 568. It should also be understood that the electrical connection on each face of the solid signal puck must not necessarily be the same although the embodiments have shown them to be the same on both sides.

In this exemplary embodiment, solid signal puck 580 generally includes a first or uphole endface 582, a longitudinally opposite second or downhole endface 584, and an outer periphery 586 extending between endfaces 582, 584. While this exemplary embodiment is described with an uphole and downhole orientation, it is reasonable to expect that the orientation could be reversed and still work well in operation. For emphasis, the solid signal puck 580 is devoid of any throughhole between endfaces 582 and 584. Solid signal puck 580 defines an electrical signal pathway (identified by double arrow 585 in FIG. 16) which extends between electrical connectors 560 and 570. Additionally, the outer periphery 586 of solid signal puck 580 has a maximum or largest diameter that is at least 40% of a maximum or largest length of solid signal puck 580.

In this exemplary embodiment, the endfaces 582 and 584 of solid signal puck 580 each include a projection 588 for engaging one of the receptacles 568 of electrical connectors 562 and 570. It may be understood that the term "projection" as used herein as construed broadly to cover projections which vary from the configuration of projection 588, including projections which are off-line. In this exemplary embodiment, the projection 588 of the downhole endface 584 is received within the receptacle 568 of the uphole electrical connector 562 to electrically connect the solid signal puck 580 with downhole perforating gun 550B. Similarly, the projection 588 of the uphole endface 582 is received within the receptacle 568 of the downhole electrical connector 570 to electrically connect the solid signal puck 580 with uphole perforating gun 550A. In this manner, projections 588 form male electrical contacts which are received in the female electrical contacts defined by electrical pin contacts 564 and 574 of electrical connectors 562 and 570, respectively. It should be noted that when considering the length of the solid signal pucks, the extent of the projections 588 should not be included in that consideration.

The relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

The invention claimed is:

1. A system for connecting a perforating gun to at least one other component in a perforating tool string, the system comprising:

a perforating gun that includes a gun housing and a charge carrier received within the gun housing wherein the charge carrier includes a first electrical connector for conducting at least one of electrical signals and electrical power;

a tool connected end-to-end with the perforating gun where the tool includes an outer sleeve and a second electrical connector within the outer sleeve for conducting at least one of electrical signals and electrical power;

a solid signal puck arranged with the perforating gun and the tool where the puck forms a pressure resistant barrier between the gun and the tool and wherein the solid signal puck includes a first endface oriented generally transverse to a longitudinal axis of the gun housing, a second endface longitudinally opposite the first endface and an outer periphery between the endfaces, wherein the solid signal puck is solid along a central axis of the solid signal puck entirely between the first endface and the second endface, and wherein the largest outer diameter of the outer periphery is at least 40% of the length between the first endface and the second endface of the puck; and wherein the solid signal puck is in direct physical contact with both the first electrical connector and with the second electrical connector for conducting at least one of electrical signals and electrical power between the first electrical connector and the second electrical connector.

2. The system of claim 1, wherein the tool that is connected end-to-end with the perforating gun is a second perforating gun.

3. The system of claim 2, wherein the perforating guns each include a separate interior void space within the gun housings, and the solid signal puck not only forms a pressure resistant barrier for the perforating guns, but also seals fluids from entering either of the interior void spaces at the end-to-end connection.

4. The system of claim 1, wherein the perforating gun includes an interior void space within the gun housing, and the solid signal puck not only forms a pressure resistant barrier for the perforating gun, but also seals fluids from entering the interior void space of the gun housing.

5. The system of claim 1, wherein an electrically conductive signal pathway is formed between the first endface and the second endface of the solid signal puck, wherein the signal pathway is electrically insulated from the gun housing.

6. The system of claim 1, wherein the solid signal puck further includes an electrically insulating surface on the outer periphery.

7. The system of claim 1, wherein the solid signal puck is at least one of frictionally, slidably and threadably received in at least one of the gun housing and the outer sleeve.

8. The system of claim 1, wherein the system further comprises a coupler that connects end-to-end to both the gun housing and the outer sleeve in a manner that secures the perforating gun to the tool.

9. The system of claim 8, wherein the coupler is positioned to coextend with at least a portion of each of the gun housing and the outer sleeve.

10. The system of claim 9, wherein at least a portion of the coupler is positioned external to the gun housing and also external to the outer sleeve and at least a portion of the solid signal puck is within a portion of the gun housing and also within a portion of the outer sleeve.

11. The system of claim 8, wherein the solid signal puck and coupler are spaced apart and not in direct physical contact with one another.

12. The system of claim 8, wherein the tool string includes an electric circuit with a positive side of the circuit and a ground side.

13. The system of claim 12, wherein the coupler is part of the ground side of the electrical circuit and the solid signal puck is part of the positive side of the electrical circuit.

14. The system of claim 8, wherein a portion of the coupler is positioned internal to the gun housing and another portion of the coupler is positioned internal to the outer sleeve.

15. The system of claim 14, wherein the coupler includes a throughbore and the solid signal puck is positioned within the throughbore and is sealed to the coupler, and wherein the coupler is sealed to the gun housing.

16. The system of claim 1, wherein at least one of the endfaces of the solid signal puck is generally planar.

17. The system of claim 1, wherein the solid signal puck is devoid of any throughhole between the first endface and the second endface.

18. The system of claim 1, wherein at least one of the endfaces of the solid signal puck includes a recess for engaging one of the electrical connectors.

19. The system of claim 1, wherein at least one of the endfaces of the solid signal puck includes a projection extending away from a center of the solid signal puck for engaging with at least one of the electrical connectors.

20. The system of claim 1, wherein the largest outer diameter of the outer periphery is at least 50% of the length between the first endface and the second endface of the solid signal puck.

21. The system of claim 1, wherein the largest outer diameter of the outer periphery is at least 75% of the length between the first endface and the second endface of the solid signal puck.

22. The system of claim 1, wherein the largest outer diameter of the outer periphery is at least 100% of the length between the first endface and the second endface of the solid signal puck.

23. The system of claim 1, wherein the largest outer diameter of the outer periphery of the solid signal puck is at least ¾ inch in diameter.

24. The system of claim 1, wherein the largest outer diameter of the outer periphery of the solid signal puck is at least ¾ inch in diameter and also at least 75% of the length between the first end face and the second end face of the solid signal puck.

25. A system for connecting a perforating gun to at least one other component in a perforating tool string, the system comprising:

a perforating gun that includes a gun housing having an inner surface defining a central passage of the gun housing, and a charge carrier received within the central passage of the gun housing wherein the charge carrier includes a first electrical connector for conducting at least one of electrical signals and electrical power;

a tool connected end-to-end with the perforating gun where the tool includes an outer sleeve and a second electrical connector received in the outer sleeve for conducting at least one of electrical signals and electrical power;

a solid signal puck positioned within the gun housing where the solid signal puck forms a pressure resistant barrier between the gun and the tool and wherein the solid signal puck includes an outer surface in sealing engagement with the inner surface of the gun housing, wherein the solid signal puck is solid along a central axis of the solid signal puck entirely between a first endface of the solid signal puck and a longitudinally opposed second endface of the solid signal puck;

wherein the solid signal puck is electrically connected to both the first electrical connector and the second electrical connector for conducting at least one of electrical signals and electrical power between the first electrical connector and the second electrical connector; and wherein the solid signal puck defines a portion of an electrical signal pathway for conducting electrical signals to the perforating gun from the surface, and the gun housing defines a portion of an electrical ground pathway for electrically grounding the perforating gun.

26. The system of claim 25, wherein the tool connected end-to-end with the perforating gun is a second perforating gun.

27. The system of claim 26, wherein the perforating guns each include a separate interior void space within the gun housings, and the solid signal puck not only forms a pressure resistant barrier for the perforating guns, but also seals fluids from entering either of the interior void spaces at the end-to-end connection.

28. The system of claim 25, wherein the first endface is oriented generally transverse to a longitudinal axis of the gun housing and an electrically conductive signal pathway is formed between the first endface and the second endface of the solid signal puck, wherein the signal pathway is electrically insulated from the gun housing.

29. The system of claim 25, wherein the solid signal puck includes an electrically insulating outer surface.

30. The system of claim 25, wherein the solid signal puck is at least one of frictionally, slidably and threadably received in the gun housing.

31. The system of claim 25, wherein at least one of the endfaces of the solid signal puck is generally planar.

32. The system of claim 25, wherein the solid signal puck is devoid of any throughhole between the first endface and the second endface.

33. The system of claim 25, wherein the largest outer diameter of an outer periphery of the solid signal puck is at least 40% of the length between the first endface and the second endface.

34. The system of claim 25, wherein at least one of the endfaces of the solid signal puck includes a recess for engaging with one of the electrical connectors.

35. The system of claim 25, wherein at least one of the endfaces of the solid signal puck includes a projection for engaging with at least one of the electrical connectors.

36. The system of claim 25, wherein the outer surface of the solid signal puck has a largest outer diameter that is at least one inch in diameter.

37. The system of claim 25, wherein the solid signal puck includes a first end face oriented generally transverse to a longitudinal axis of the gun housing and a second end face longitudinally opposite the first end face and an outer periphery between the end faces; and further wherein the largest outer diameter of the outer surface of the solid signal puck is at least one inch in diameter and is also at least 75% of the length between the first end face and the second end face of the solid signal puck.

38. A perforating gun for use in a perforating tool string for perforating a casing string in a wellbore, the perforating gun comprising:

a generally tubular gun housing having opposite open ends and an outer wall extending between the open ends;

a charge carrier received within the tubular gun housing wherein the charge carrier includes a pair of electrical connectors with one positioned at each open end of the tubular gun housing for conducting at least one of electrical signals and electrical power;

a solid signal puck devoid of any throughhole and arranged to close and seal a first of the open ends of the tubular gun housing thereby closing an interior void space within the tubular gun housing with the charge carrier positioned therein;

a closure arranged to close and seal a second of the open ends of the tubular gun housing thereby closing the other end of the interior void space within the tubular gun housing at a first end of the generally tubular gun housing;

wherein the solid signal puck forms a pressure resistant barrier protecting the interior void space at a second end of the tubular gun housing; and wherein the solid signal puck is electrically connected with one of the electrical connectors of the charge carrier for conducting at least one of electrical signals and electrical power with the one electrical connector and also electrically insulated from the tubular gun housing.

39. The perforating gun of claim 38, wherein the solid signal puck includes an outer periphery in sealing engagement with an inner surface of the tubular gun housing.

40. The perforating gun of claim 38, wherein the solid signal puck includes a first endface oriented generally transverse to a longitudinal axis of the tubular gun housing and a second endface longitudinally opposite the first endface and an outer periphery wherein a largest outer diameter of the outer periphery is at least 40% of the length between the first endface and the second endface of the solid signal puck.

41. The perforating gun of claim 40, wherein the largest outer diameter is at least ¾ inch in diameter.

42. The perforating gun of claim 41, wherein the largest outer diameter is at least 75% of the length between the first end face and the second end face of the solid signal puck.

43. The perforating gun of claim 38, wherein the solid signal puck includes a first endface oriented generally transverse to a longitudinal axis of the tubular gun housing and a second endface longitudinally opposite the first endface wherein at least one of the endfaces of the solid signal puck includes a recess for engaging with the respective electrical connector.

44. The perforating gun of claim 38, wherein the solid signal puck includes a first endface oriented generally transverse to a longitudinal axis of the tubular gun housing and a second endface longitudinally opposite the first endface wherein at least one of the endfaces of the solid signal pucks includes a projection for engaging with the respective electrical connector.

45. The perforating gun of claim 38, wherein the closure comprises a second solid signal puck arranged to close and seal a second of the second of the open ends of the tubular gun housing and forming a pressure resistant barrier protecting the interior void space at the second end of the generally tubular gun housing.

46. The perforating gun of claim 38, wherein the closure includes an assembly comprising a generally tubular body with an open bore and a second solid signal puck is sealed within the bore of the tubular body.

47. The perforating gun of claim 38, wherein the closure comprises a second generally tubular gun housing that is inserted into the second end of the first mentioned tubular gun housing and wherein the second end of the first mentioned tubular gun housing is closed and sealed by O-ring seals engaged with an inside of the second end of the first mentioned tubular gun housing, and further wherein a second solid signal puck is positioned inside the second tubular gun housing and sealed to a bore of the second generally tubular gun housing, and further wherein the second solid signal puck is arranged to be in direct physical contact with the other of the electrical connectors of the charge carrier inside the first mentioned tubular gun housing.

* * * * *